US008297731B2

(12) United States Patent
Ochiai et al.

(10) Patent No.: US 8,297,731 B2
(45) Date of Patent: Oct. 30, 2012

(54) RECORDING APPARATUS CAPABLE OF CHECKING POSITIONS OF INK CONTAINERS, AND METHOD FOR CHECKING THE POSITIONS

(75) Inventors: Takayuki Ochiai, Inagi (JP); Akira Kuribayashi, Kawasaki (JP); Yasuhiko Ikeda, Sagamihara (JP); Mitsuyuki Fujibayashi, Kawasaki (JP); Kenji Kitabatake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/559,339

(22) Filed: Sep. 14, 2009

(65) Prior Publication Data

US 2010/0002040 A1 Jan. 7, 2010

Related U.S. Application Data

(63) Continuation of application No. 11/424,950, filed on Jun. 19, 2006, now Pat. No. 7,604,317.

(30) Foreign Application Priority Data

Jun. 21, 2005 (JP) ..... 2005-180541

(51) Int. Cl.
*B41J 29/393* (2006.01)
*B41J 2/14* (2006.01)

(52) U.S. Cl. ..... 347/19; 347/49

(58) Field of Classification Search ..... 347/5, 19, 347/49, 86, 87
See application file for complete search history.

(56) References Cited

U.S. PATENT DOCUMENTS

| | | | | |
|---|---|---|---|---|
| 4,872,027 | A * | 10/1989 | Buskirk et al. | 347/19 |
| 4,930,915 | A * | 6/1990 | Kikuchi et al. | 400/175 |
| 5,049,904 | A * | 9/1991 | Nakamura et al. | 347/19 |
| 6,053,597 | A * | 4/2000 | Hirota | 347/19 |
| 6,299,274 | B1 * | 10/2001 | Bolash et al. | 347/19 |
| 6,390,590 | B1 * | 5/2002 | Hansburg | 347/19 |
| 7,213,914 | B2 * | 5/2007 | Anma et al. | 347/86 |
| 7,237,881 | B2 * | 7/2007 | Hayasaki et al. | 347/86 |
| 7,455,382 | B2 * | 11/2008 | Kuribayashi et al. | 347/19 |
| 7,604,317 | B2 * | 10/2009 | Ochiai et al. | 347/19 |

* cited by examiner

*Primary Examiner* — Anh T. N. Vo
(74) *Attorney, Agent, or Firm* — Canon USA Inc. IP Division

(57) ABSTRACT

A recording apparatus includes a carriage, ink containers mounted in the carriage and including respective light emitters, a driving unit for moving the ink tanks, a light receiver receiving light from the light emitters, a light control unit controlling lighting the light emitter of a predetermined ink container, and a determining unit for determining whether the predetermined ink container is mounted at a correct position, based on the light emitted from the light emitter of the predetermined ink container at positions. When the driving unit does not move the carriage to a position where at least one of the ink containers is facing the light receiver, the determining unit determines whether the at least one of the ink containers is mounted at the correct position, based on the light received from the light emitters at a position adjacent to the facing position.

18 Claims, 26 Drawing Sheets

→ POSITION

| LIGHTED TANK ↓ | K | C | M |
|---|---|---|---|
| K | 563 | 38 | 3 |
| C | 5 | 62 | 4 |
| M | 1 | 22 | 323 |
| Y | | | 44 |

→ POSITION

| LIGHTED TANK ↓ | K | C | M |
|---|---|---|---|
| K | 563 | 38 | 3 |
| C | 5 | 62 | 4 |
| M | 1 | 22 | 323 |
| Y | | 3 | 44 |

→ POSITION

| LIGHTED TANK ↓ | K | C | M |
|---|---|---|---|
| K | 563 | 38 | 3 |
| C | 5 | 62 | 4 |
| M | 1 | 22 | 323 |
| Y | 1 | 3 | 44 |

| | K | C | M |
|---|---|---|---|
| K | 563 | 38 | 3 |
| C | | | 4 |
| M | | | |
| Y | | | |

| | K | C | M |
|---|---|---|---|
| K | 563 | 38 | 3 |
| C | | 62 | 4 |
| M | | | |
| Y | | | |

| | K | C | M |
|---|---|---|---|
| K | 563 | 38 | 3 |
| C | 5 | 62 | 4 |
| M | | | |
| Y | | | |

| | K | C | M |
|---|---|---|---|
| K | 563 | 38 | 3 |
| C | 5 | 62 | 4 |
| M | 1 | | |
| Y | | | |

| | K | C | M |
|---|---|---|---|
| K | 563 | 38 | 3 |
| C | 5 | 62 | 4 |
| M | 1 | 1 | |
| Y | | | |

| | K | C | M |
|---|---|---|---|
| K | 563 | 38 | 3 |
| C | 5 | 62 | 4 |
| M | 1 | 1 | 22 |
| Y | | | |

| | K | C | M |
|---|---|---|---|
| K | 563 | 38 | 3 |
| C | 5 | 62 | 4 |
| M | 1 | 1 | 22 |
| Y | | | 663 |

| | K | C | M |
|---|---|---|---|
| K | 563 | 38 | 3 |
| C | 5 | 62 | 4 |
| M | 1 | 1 | 22 |
| Y | | 44 | 663 |

| | K | C | M |
|---|---|---|---|
| K | 563 | 38 | 3 |
| C | 5 | 62 | 4 |
| M | 1 | 1 | 22 |
| Y | 3 | 44 | 663 |

| | C | M | Y |
|---|---|---|---|
| K | 38 | | |
| C | 124 | 8 | |
| M | 22 | 323 | |
| Y | | 44 | 663 |
| G | 1 | | |

| | C | M | Y |
|---|---|---|---|
| K | 38 | | 3 |
| C | 124 | 8 | |
| M | 22 | 323 | |
| Y | | 44 | 663 |
| G | 1 | | |

| | C | M | Y |
|---|---|---|---|
| K | 38 | | 3 |
| C | 124 | 8 | |
| M | 22 | 323 | 20 |
| Y | | 44 | 663 |
| G | 1 | | |

| | C | M | Y |
|---|---|---|---|
| K | 38 | | 3 |
| C | 124 | 8 | |
| M | 22 | 323 | 20 |
| Y | | 44 | 663 |
| G | 1 | | 25 |

| | C | M | Y |
|---|---|---|---|
| K | 3 | | |
| C | 124 | 8 | |
| M | 22 | 323 | |
| Y | | 44 | 663 |
| G | 25 | | |

| | C | M | Y |
|---|---|---|---|
| K | 3 | | 3 |
| C | 124 | 8 | |
| M | 22 | 323 | |
| Y | | 44 | 663 |
| G | 25 | | |

| | C | M | Y |
|---|---|---|---|
| K | 3 | | 38 |
| C | 124 | 8 | |
| M | 22 | 323 | 20 |
| Y | | 44 | 663 |
| G | 25 | | |

| | C | M | Y |
|---|---|---|---|
| K | 3 | | 38 |
| C | 124 | 8 | |
| M | 22 | 323 | 20 |
| Y | | 44 | 663 |
| G | 25 | | 1 |

RECORDING APPARATUS CAPABLE OF CHECKING POSITIONS OF INK CONTAINERS, AND METHOD FOR CHECKING THE POSITIONS

CROSS-REFERENCE TO RELATED APPLICATIONS

This application is a continuation of application Ser. No. 11/424,950, filed Jun. 19, 2006, the contents of which are hereby incorporated by reference.

BACKGROUND OF THE INVENTION

1. Field of the Invention

The present invention relates to a position checking method, and more particularly, to a position checking method in which the mounting positions of ink tanks are specified in a recording apparatus.

2. Description of the Related Art

According to recent demands to further improve image quality, not only four popular color inks (black, yellow, magenta, and cyan), but also a light magenta ink and a light cyan ink having low density have been used. Further, the use of so-called particular color inks, such as a red ink and a blue ink, has been proposed. When these inks are used, seven or eight ink tanks corresponding to the colors are individually mounted in an inkjet printer. In this case, a mechanism is necessary to prevent the ink tanks from being mounted at wrong positions. Japanese Patent Laid-Open No. 2001-253087 discloses that the engaged portions between a carriage and ink tanks have different shapes. This prevents the ink tanks from being mounted improperly.

In order to specify the mounting positions of the ink tanks, the engaged portions between the carriage and the ink tanks have different shapes, as described above. In this case, however, it is necessary to produce ink tanks that have different shapes corresponding to the colors and types of ink. This is disadvantageous in terms of production efficiency and cost.

As another method, it is conceivable to separately provide different circuit signal lines of circuits, which are formed by connecting electrical contacts of ink tanks and electrical contacts provided at the mounting positions of the ink tanks in a carriage of a main unit, corresponding to the mounting positions. For example, it is conceivable to respectively provide different signal lines corresponding to the mounting positions in order to read ink color information from the ink tanks, and to control lighting of LEDs. When the color information read from any of the ink tanks does not correspond to the mounting position, it is determined that the ink tank is mounted improperly.

However, when the signal lines are thus separately provided corresponding to the ink tanks or the mounting positions, the number of signal lines increases. In particular, there is a tendency to improve image quality by increasing the number of types of inks in recent inkjet printers, as described above. In these printers, particularly, the increase in the number of signal lines increases the cost. A so-called bus connection using a common signal line is effective in reducing the number of signal lines. However, it is apparent that the ink tank or the mounting position of the ink tank cannot be determined by simply using a common signal line like a bus connection.

Accordingly, a position checking method is conceivable in which lighting of LEDs at mounting positions of a plurality of ink tanks is controlled by a common signal line, and in which the mounting positions of the ink tanks can be determined.

However, the amount of emitted light varies among the LEDs, and therefore, the amount of light received by a light receiver provided in the printer also varies. For this reason, it is sometimes difficult to check the presence or absence of emitted light with reference to a threshold value depending on the amount of received light, and to thereby check the positions of the ink tanks. Although this problem can be solved by reducing the variation in the amount of emitted light, the cost is increased, for example, because there is a need to screen LEDs. A method has been proposed in which LEDs of a plurality of ink tanks mounted in a carriage are sequentially caused to emit light at predetermined positions during movement of the carriage, and in which the light emission is detected at the predetermined positions. In this position checking method, even when the amount of emitted light markedly varies among the LEDs of the ink tanks, it can be checked whether the ink tanks are mounted at correct positions. This allows the mounting positions of the ink tanks to be specified without increasing the cost.

In recent consumer-oriented inkjet printers, there is a tendency to attach importance to size reduction in order to increase sales function. For this reason, it is sometimes impossible to place a light receiver of a printer at a position best suited to the specification of the mounting positions of ink tanks, and to move the carriage so that all the ink tanks are placed at optimal positions.

SUMMARY OF THE INVENTION

The present invention is directed to a position checking method that can specify mounting positions of liquid containers, such as ink tanks, even when any of the liquid containers cannot be moved to a position such as to face a light receiver, and a recording apparatus.

According to an aspect of the present invention, a recording apparatus includes a carriage, a plurality of ink containers, each ink container including a light emitter and mounted at a respective position in the carriage, a light receiver configured to receive light from the light emitters, a driving unit configured to move the carriage such that the ink containers are moved to a plurality of positions relative to the light receiver, wherein the ink containers are mounted in the carriage such that at least one of the ink containers is capable of moving to a facing position facing the light receiver and at least one of the ink containers is not capable of moving to the facing position, a lighting control unit controlling lighting the light emitters of the ink containers, and a determining unit determining whether a predetermined ink container of the ink containers is mounted at the respective correct position in the carriage, based on the light emitted from the light emitter of the predetermined ink container at the plurality of positions received by the light receiver, wherein the determining unit determines whether the at least one of the ink containers not capable of moving to the facing position is mounted at the respective correct position in the carriage, based on the light received from the light emitter of the ink container adjacent thereto.

Further features of the present invention will become apparent from the following description of exemplary embodiments with reference to the attached drawings.

DESCRIPTION OF THE EMBODIMENTS

First Embodiment

Figure 15:
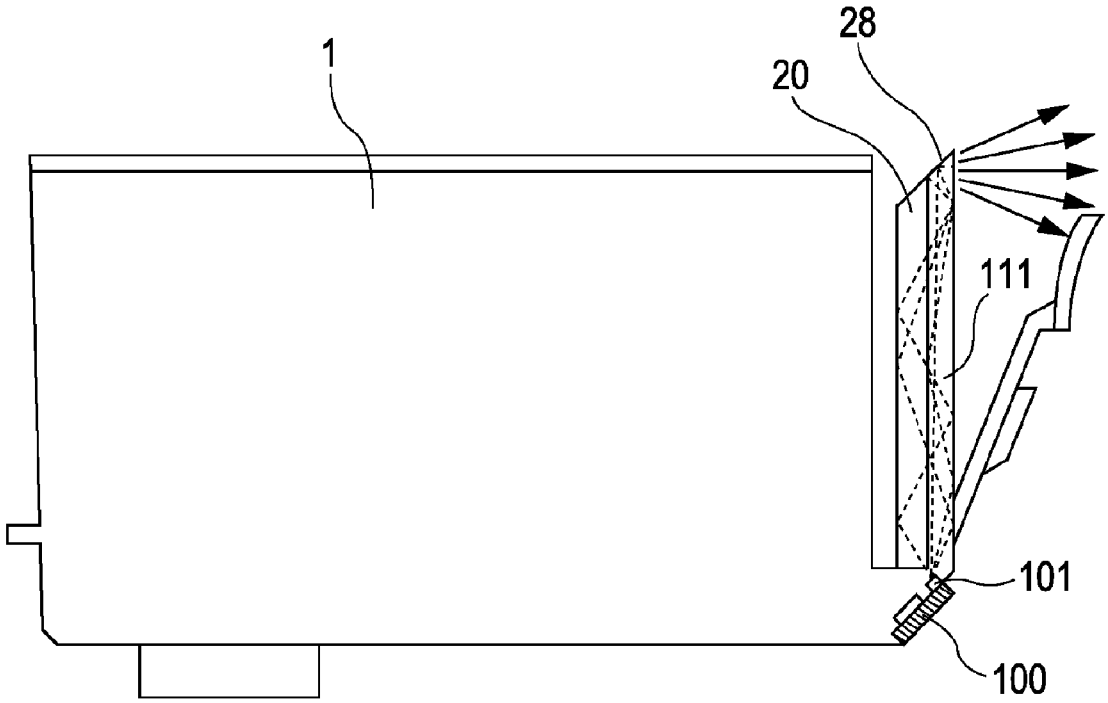
FIG. 15 is a side view of an ink tank adopted in the embodiments.

FIG. 15 is a side view of an ink tank 1 according to a first embodiment of the present invention. A substrate 100 on which an LED 101 is mounted is provided in the ink tank 1. Light emitted from the LED 101 is guided in a light guide 20, is reflected by an inclined portion 28, and is emitted toward the right side of the ink tank 1 in the figure, thus forming an optical path 111.

Figure 16:
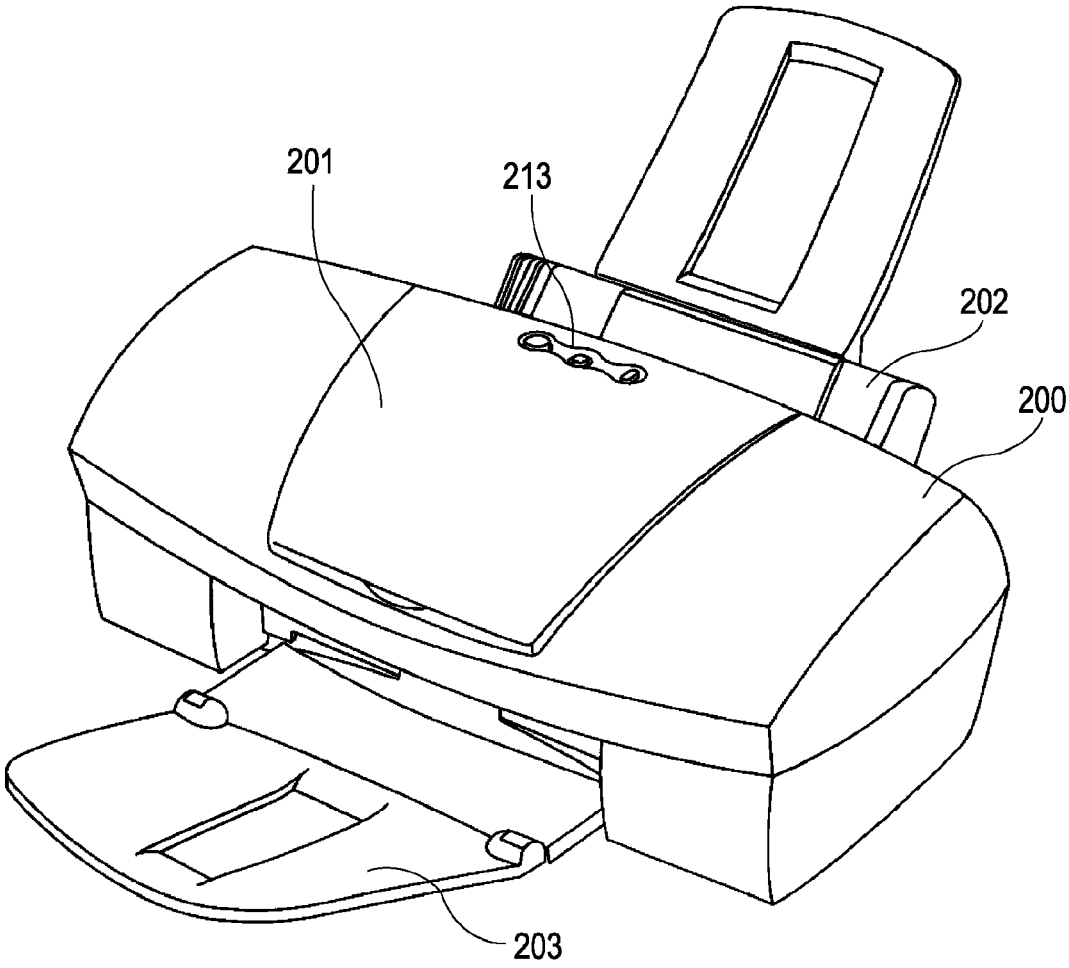
FIG. 16 is an outside perspective view of an inkjet printer that performs recording with the ink tank mounted therein.
Figure 17:
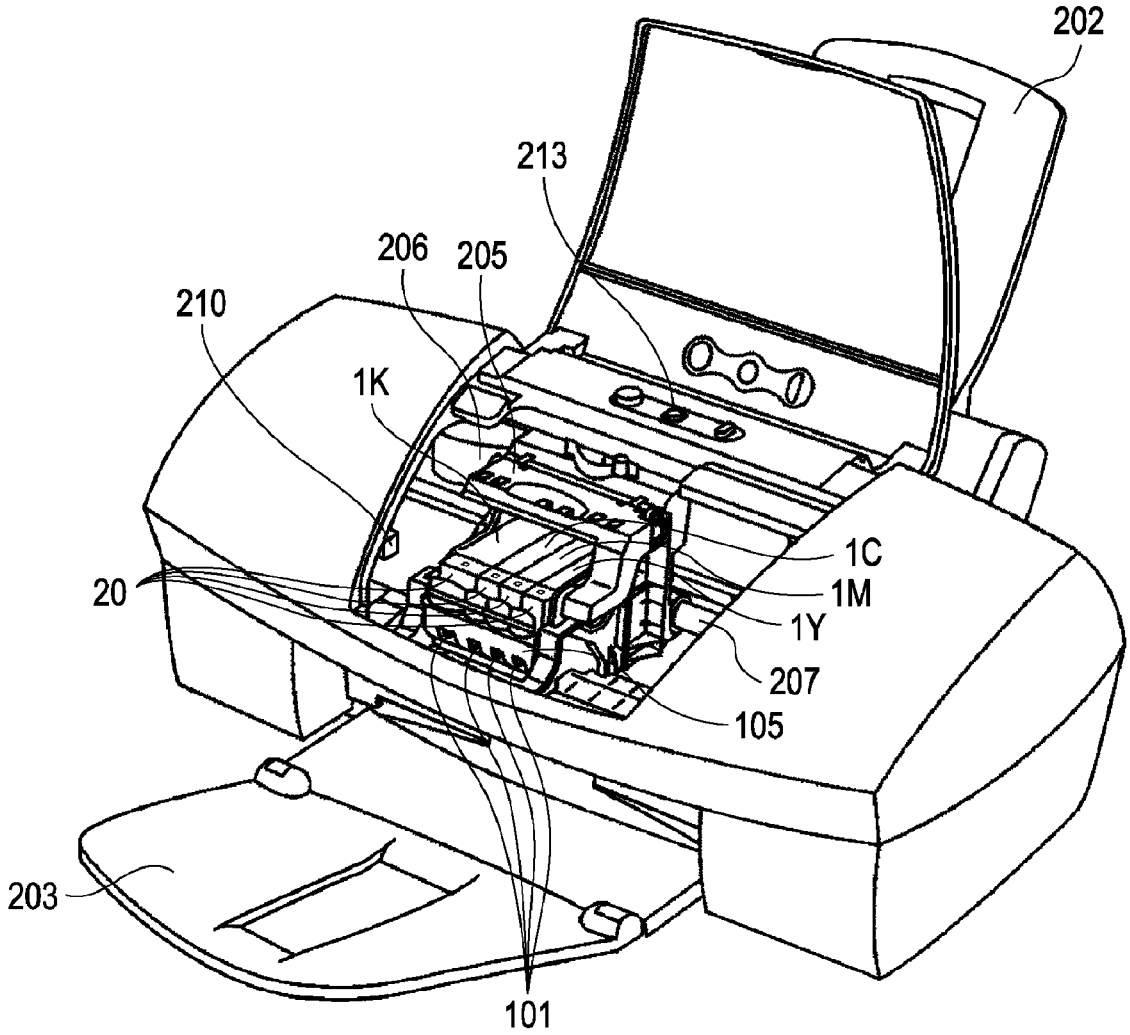
FIG. 17 is a perspective view of the inkjet printer from which a main cover is removed.

FIG. 16 is an outside view of an inkjet printer 200 that performs recording with the above-described ink tank 1 mounted therein. FIG. 17 is a perspective view showing a state in which a main cover 201 of the inkjet printer 200 shown in FIG. 16 is opened.

As shown in FIG. 16, a main part of the inkjet printer 200 is formed by a mechanism that performs recording by scanning a carriage 205 on which recording heads and ink tanks are mounted. The main part includes a main unit covered with the main cover 201 and other case portions, ejection trays 203 respectively provided on the front and rear sides of the main unit, and an automatic sheet feeder (ASF) 202. The printer 200 also includes an operating unit 213 having a display that indicates the condition of the printer 200 in both states in which the main cover 201 is closed and opened, a power switch, and a reset switch.

In a state in which the main cover 201 is opened, a user can see a range in which the carriage 205 having a recording head unit 105 and ink tanks 1K, 1C, 1M, and 1Y mounted thereon moves, and the surroundings of the range (hereinafter, the ink tanks 1K, 1C, 1M, and 1Y are sometimes denoted by the same reference numeral "1"). In actuality, when the main cover 201 is opened, a sequence in which the carriage 205 automatically moves to almost the center position in the figure (hereinafter also referred to as a "tank replacement position") is performed. The user can replace each ink tank at the tank replacement position.

The recording head unit 105 includes chip-shaped recording heads (not shown) corresponding to color inks of K, C, M, and Y. The recording heads are scanned over a recording medium, such as a sheet of paper, by the movement of the carriage 205, and discharge ink onto the recording medium for recording during the scanning operation. That is, the carriage 205 is slidably engaged with a guide shaft 207 that extends in the moving direction thereof, and can be moved by a carriage motor and a mechanism for transmitting the driving force from the carriage motor. The recording heads respectively discharge the K, C, M, and Y color inks according to discharging data sent from a control circuit in the main unit via a flexible cable 206. A sheet feeding mechanism including a sheet feeding roller and an ejection roller is also provided to convey a recording medium (not shown) supplied from the automatic sheet feeder 202 onto the ejection tray 203. The recording head unit 105 with which ink tank holders are provided integrally is detachably mounted on the carriage 205. The ink tanks 1 are detachably mounted in the recording head unit 105.

During recording, each of the recording heads is scanned while discharging ink onto the recording medium to record in a region having a width corresponding to discharge openings of the recording head. Also, the recording medium is conveyed by a predetermined amount corresponding to the above-described width by the sheet feeding mechanism between scanning operations, so that recording on the recording medium is performed sequentially. A discharging recovery unit, such as a cap, is provided at an end of the range, in which the recording heads are moved by the movement of the carriage 205, to cover surfaces of the recording heads on which the discharge openings are provided. The recording heads are moved to the recovery unit at predetermined time intervals so as to be subjected to recovery operation such as preliminary discharging.

The recording head unit 105 having the tank holders for the ink tanks 1 has connectors corresponding to the ink tanks 1, as described above. Each of the connectors is in contact with a pad provided on the corresponding ink tank 1. This allows control of lighting and flashing of each LED 101.

More specifically, when the amount of ink remaining in any of the ink tanks 1 becomes low, the LED 101 corresponding to the ink tank 1 is turned on or flashed at the above-described tank replacement position. In this case, the user can observe light guided from the LED 101 in the light guide 20 by seeing the ink tank 1 from above the printer 200.

A light receiver 210 having a light receiving element is provided near an end of the recording-head moving range opposite from the above-described discharging recovery unit. When passing through the light receiver 210 during movement of the carriage 205, the LED 101 of each ink tank 1 is turned on, and light from the LED 101 is received by the light receiver 210. Moreover, it is possible to check the position of each ink tank 1 in the carriage 205 on the basis of the position of the carriage 205 obtained when the light from the LED 101 is received. The black ink tank 1K, the cyan ink tank 1C, and the magenta ink tank 1M are movable to a position facing the light receiver 210. In contrast, the yellow ink tank 1Y is incapable of moving to the position facing the light receiver 210 because of the position of the outer case of the printer 200.

As another example of a method for controlling lighting of the LED 101, when the ink tank 1 is properly mounted, control is exerted so that the LED 101 of the ink tank 1 is turned on when the ink tank 1 is properly mounted at the tank replacement position. These control operations are carried out according to control data (control signal) transmitted from the control circuit in the main unit to each ink tank 1 via the flexible cable 206, in a manner similar to that for the control of ink discharging by the recording heads.

Figure 18:
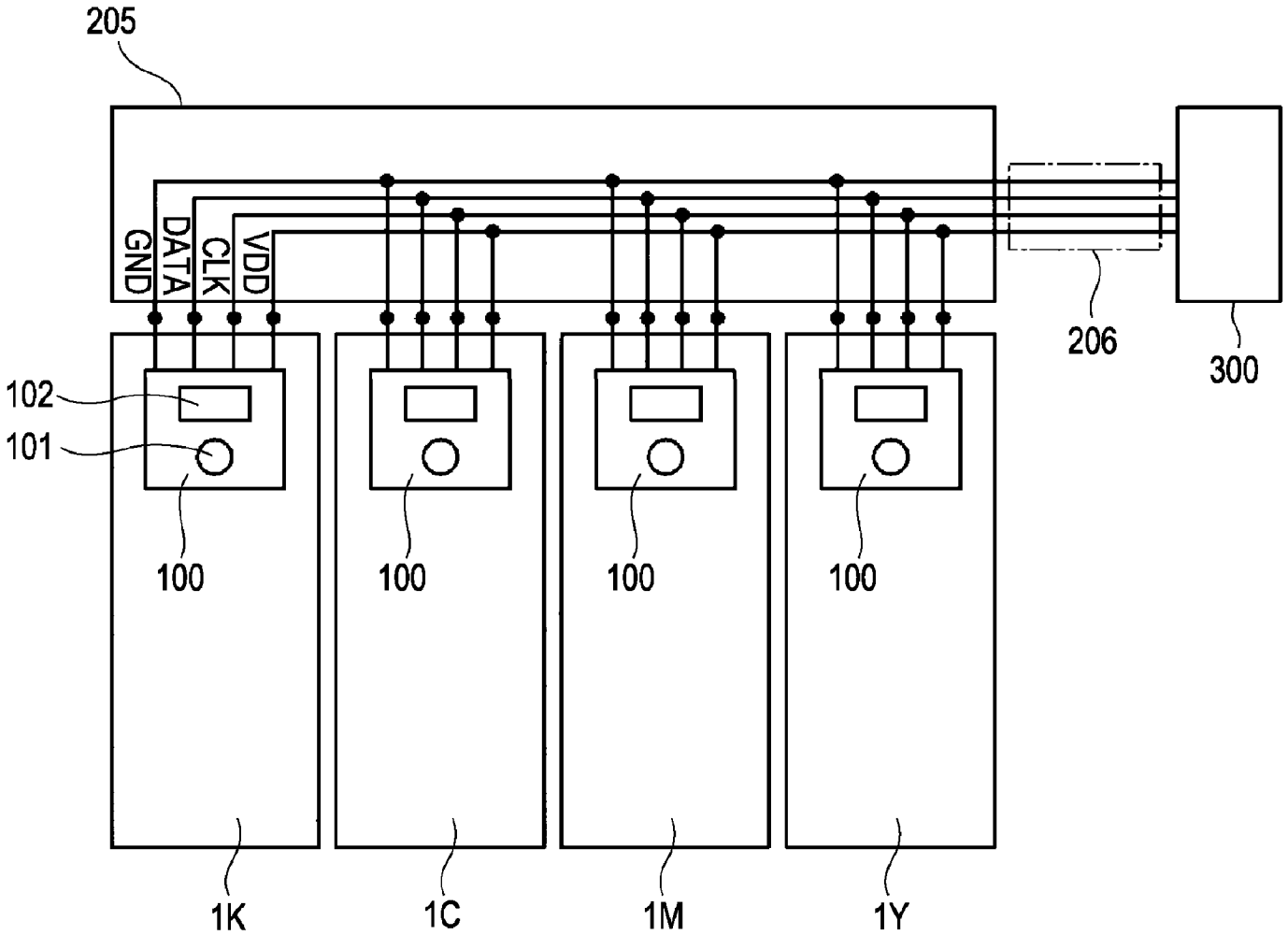
FIG. 18 is a conceptual view showing signal lines for connection between the inkjet printer and the ink tanks in conjunction with substrates of the ink tanks.

FIG. 18 shows a wiring structure of the flexible cable 206 for connecting the ink tanks 1 and a control circuit 300, in conjunction with substrates 100 of the ink tanks 1.

As shown in FIG. 18, the wiring structure for the four ink tanks 1 includes four signal lines, and is common to the ink tanks 1 (so-called bus connection). That is, a wiring structure for each ink tank 1 includes four signal lines, namely, a power signal line VDD, a ground signal line GND, a signal line DATA, and a clock signal line CLK. The power signal line VDD is concerned with the supply of power for the operation of a function element in an IC package 102 that lights and drives the LED 101 in the ink tank 1. The signal line DATA transmits control signals (control data) relating operations, such as lighting and flashing of the LED 101, from the control circuit 300, as will be described below. While the four signal lines are used in the first embodiment, the present invention is not limited thereto. For example, the ground signal line GND may be omitted by obtaining a ground signal by other methods. The signal lines CLK and DATA may be combined into one. In this case, there is no need to provide a signal line DATA for each ink tank 1, and the number of signal lines in the flexible cable 206 can be reduced. For example, when a signal line DATA is provided for each of eight color ink tanks in the printer, eleven lines, that is, eight signal lines DATA, a power signal line VDD, a ground signal line GND, and a clock signal line CLK are necessary. This complicates the wiring structure of the flexible cable 206, and increases the cost. For this reason, the above-described bus connection provides a cost advantage to the printer in which a plurality of color ink tanks are mounted.

The control circuit 300 performs data processing and operation control in the printer 200. For that purpose, the control circuit 300 includes a CPU, a ROM that stores a program for operation control, and a RAM serving as a work area, although they are not shown.

Figure 20:
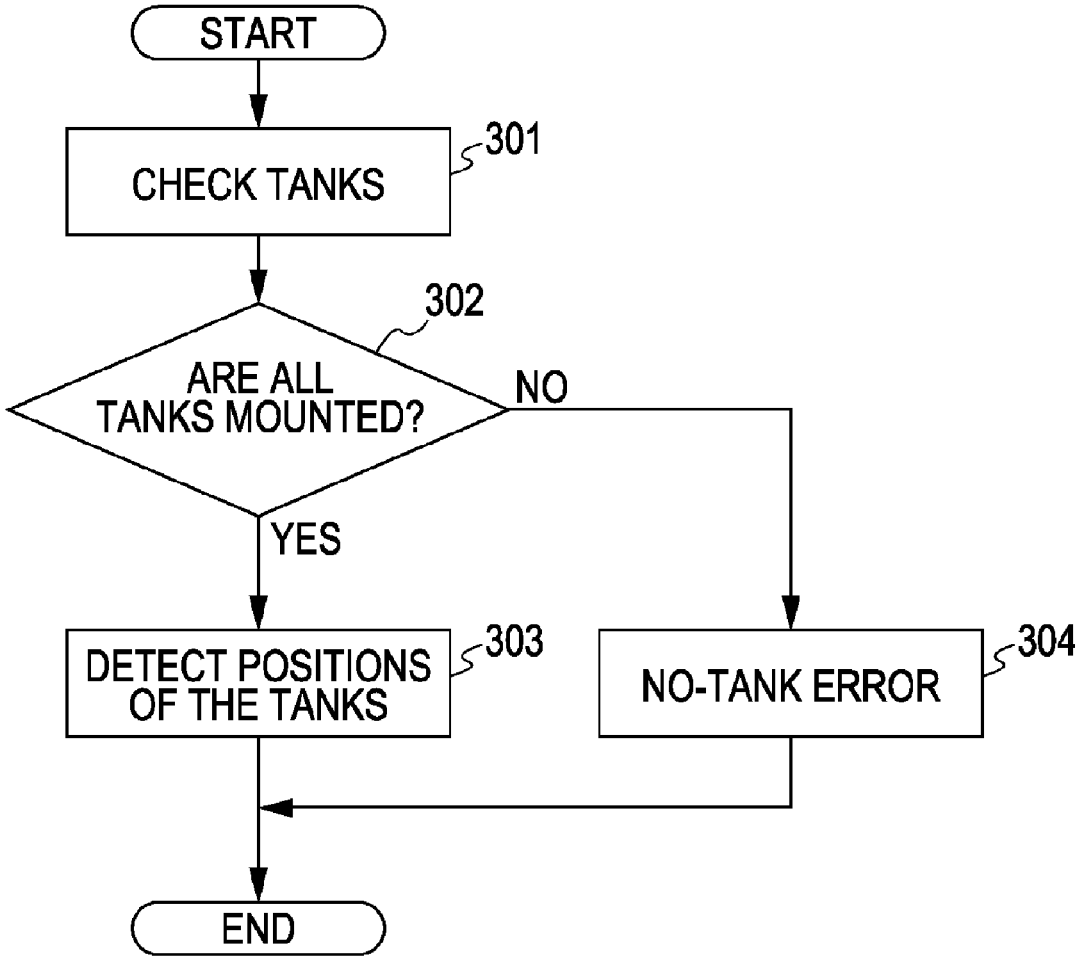
FIG. 20 is a flowchart showing a control procedure performed in the embodiments.
Figure 21A:
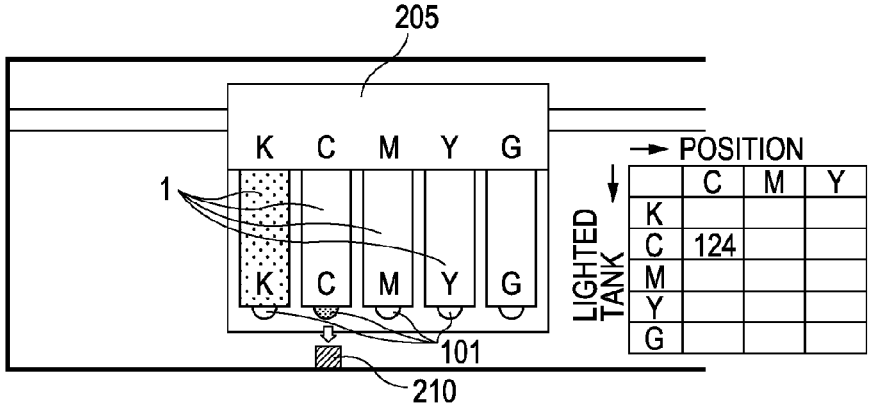
FIGS. 21A, 21B, 21C, and 21D are schematic views showing a position checking procedure according to a third embodiment of the present invention.
Figure 21B:
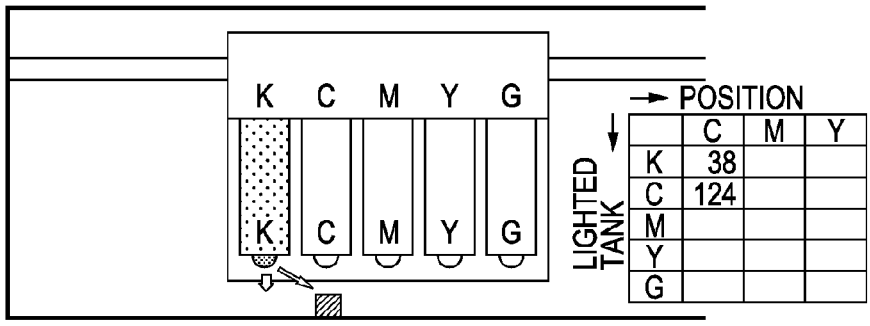
Figure 21C:
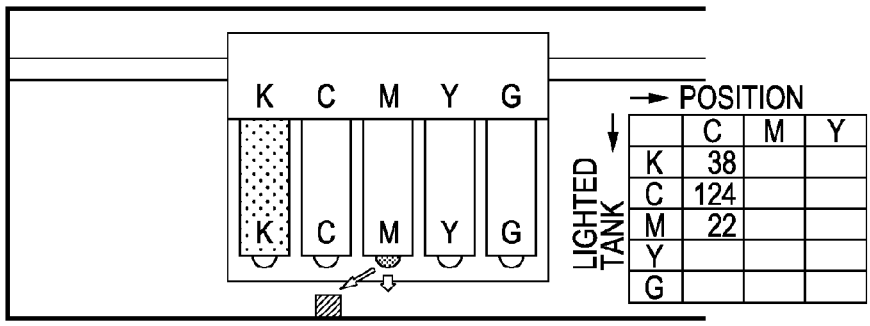
Figure 21D:
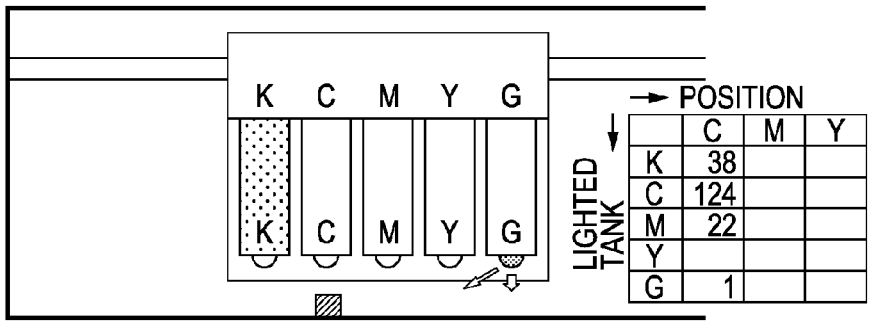

FIG. 20 is a flowchart showing a procedure performed in the first embodiment. In Step 301, it is determined whether all necessary ink tanks are mounted in the printer 200. Determination is performed, for example, by transmitting a lights-out command to each of the ink tanks 1 and receiving a response from the ink tank 1. The determination result obtained in Step 301 is evaluated in Step 302. When it is not confirmed that all the necessary ink tanks are mounted, the printer 200 informs the operator of a no-tank error and urges the operator to mount all the ink tanks in Step 304, thereby completing the procedure. When all the ink tanks are mounted, an operation for checking the positions of the ink tanks 1 is performed in Step 303, and the procedure is completed. The position checking operation in Step 303 will be described in detail below.

Figure 19:
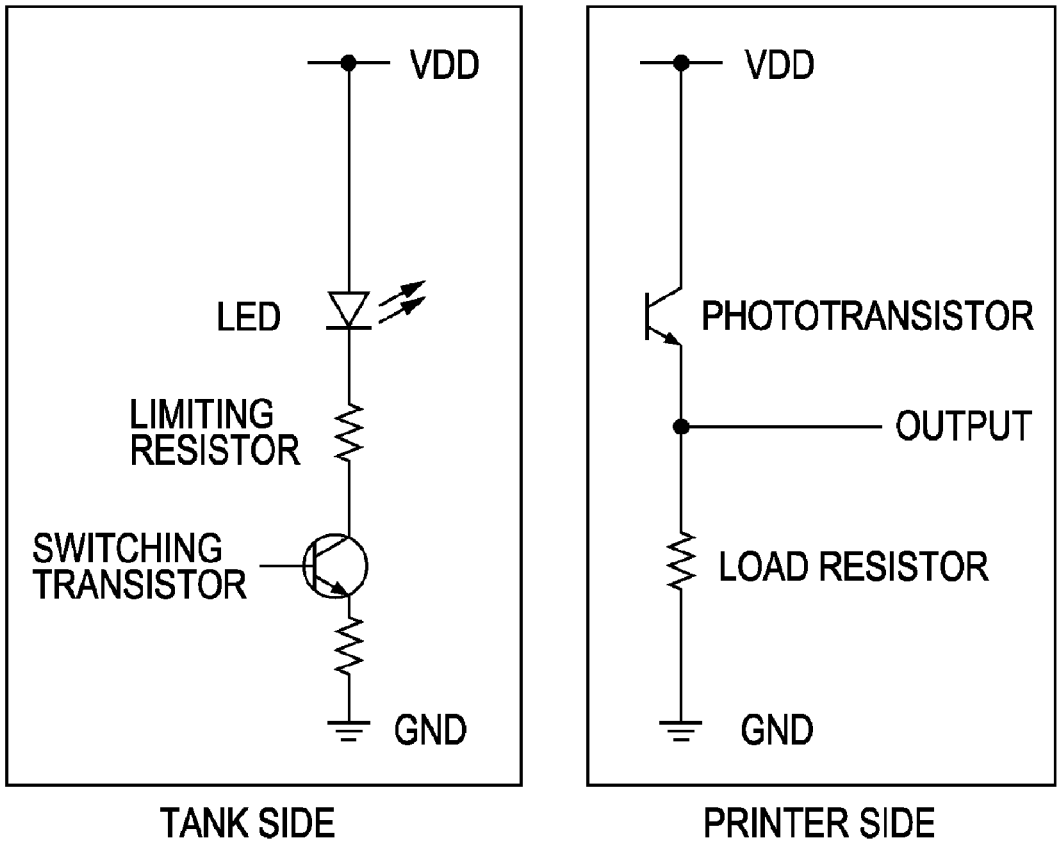
FIG. 19 is a circuit diagram showing the configurations of a light-emitting circuit of the ink tank and a light-receiving circuit of a light receiver.

FIGS. 1 to 4 are schematic views showing a position checking procedure performed in the first embodiment. The steps shown in FIGS. 1A to 4C are performed sequentially. The carriage 205 is movable along the guide shaft 207, and includes four positions, namely, a black position K, a cyan position C, a magenta position M, and a yellow position Y arranged in that order from the left side. The black ink tank 1K, the cyan ink tank 1C, the magenta ink tank 1M, and the yellow ink tank 1Y are respectively mounted at the black position K, the cyan position C, the magenta position M, and the yellow position Y. The light receiver 210 is fixed on the main unit (not shown) of the printer 200. The light receiver 210 is a sensor which can be formed of a phototransistor, and a photocurrent varies depending on the amount of light received by the light receiver 210. In the first embodiment, a circuit shown in FIG. 19 detects a change of the photocurrent as a voltage change when an output potential having a VDD of 3300 mV and a load resistance of 150 kΩ is used as the reference potential. That is, the amount of received light is expressed as the voltage. FIGS. 1 to 4 show states in which the ink tanks 1 are properly mounted at correct positions in the carriage 205. Light emission of the light emitting element, detection of a photocurrent in accordance with the amount of received light, movement of the carriage 205, and checking of the ink tank positions, which will be described below, are controlled according to the program stored in the ROM of the control circuit 300.

A description will be given below of a case in which only the yellow position Y cannot be moved to a position such as to face the light receiver 210.

Figure 1A:
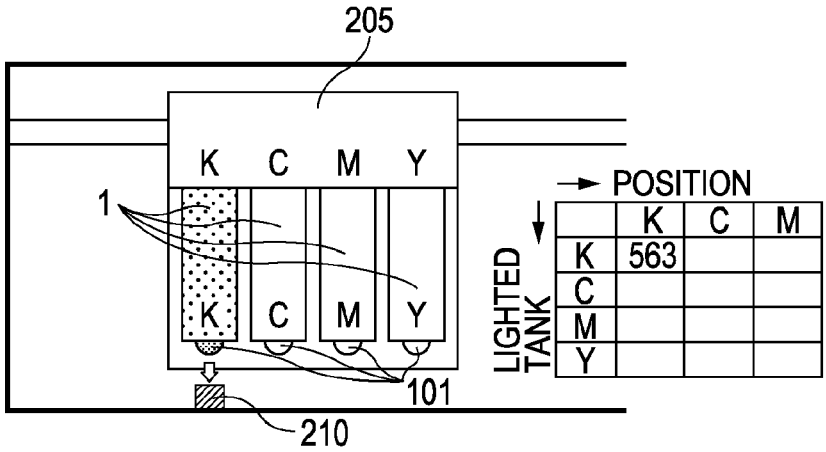
FIGS. 1A, 1B, and 1C are schematic views showing a position checking procedure according to a first embodiment of the present invention.
Figure 1B:
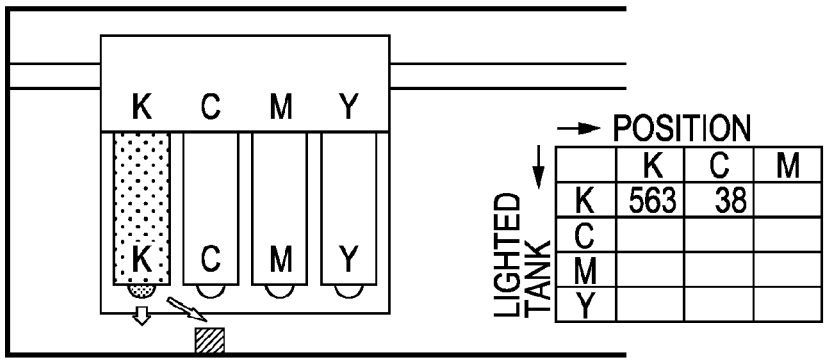
Figure 1C:
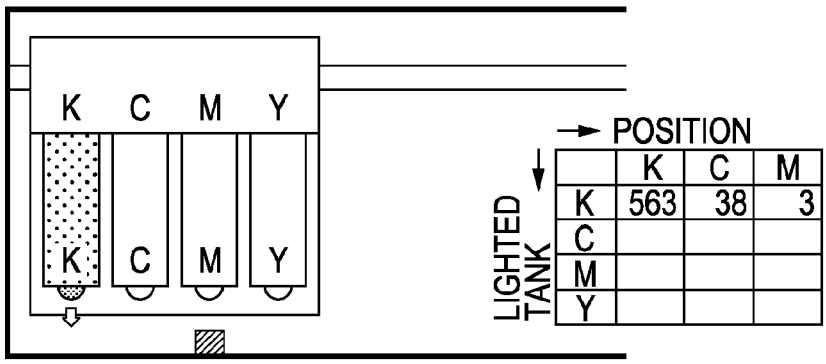

First, the LED 101 of the black ink tank 1K is first turned on in FIGS. 1A to 1C. In FIG. 1A, the light receiver 210 faces the black ink tank 1K. In this case, the amount of light received by the light receiver 210 is about 563 mV. In the state shown in FIG. 1B, the carriage 205 is moved along the guide shaft 207 to the left by a distance corresponding to one ink tank, and the light receiver 210 faces the cyan ink tank 1C. In this case, since the LED 101 of the black ink tank 1K is turned on, the amount of light that reaches the light receiver 210 is about 38 mV, which is smaller than when the light receiver 210 faces the black ink tank 1K. In the state shown in FIG. 1C, the carriage 205 is further moved to the left by a distance according to one ink tank, and the light receiver 210 faces the magenta ink tank 1M. In this case, the amount of light received by the light receiver 210 is further reduced to about 3 mV.

Figure 2A:
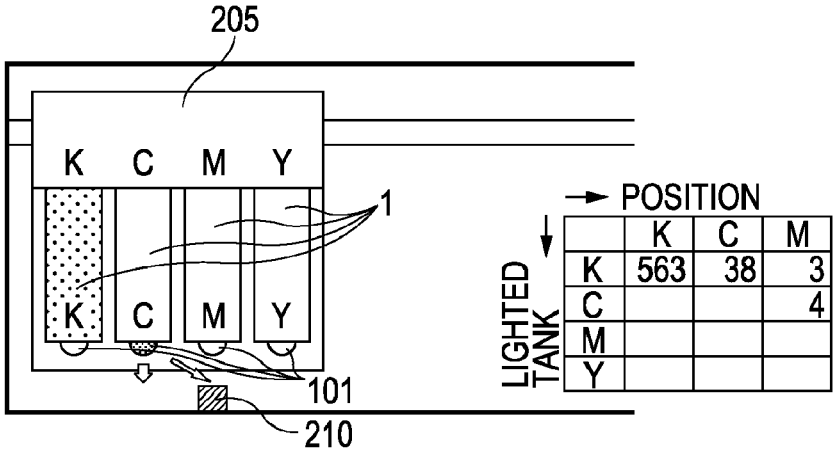
FIGS. 2A, 2B, and 2C are schematic views showing the position checking procedure.
Figure 2B:
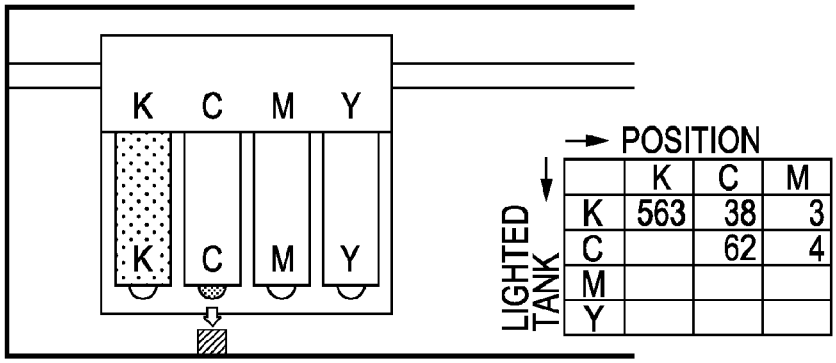
Figure 2C:
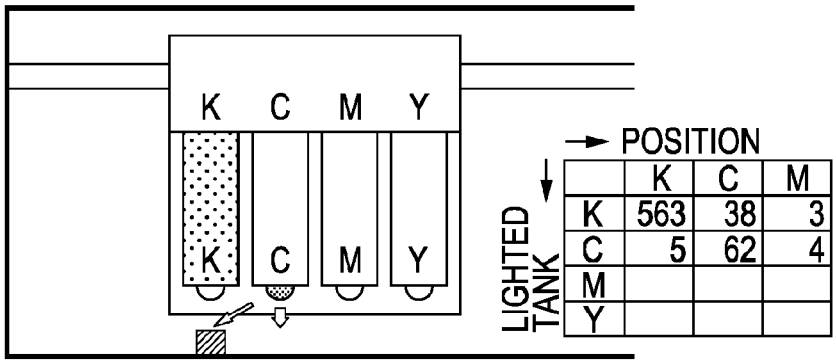
Figure 3A:
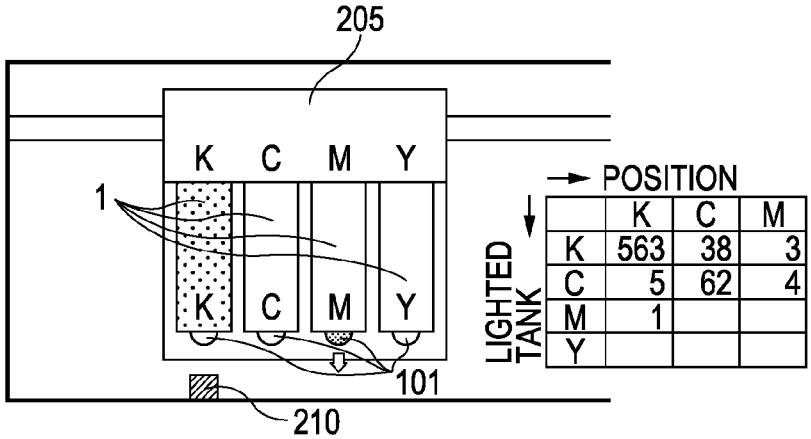
FIGS. 3A, 3B, and 3C are schematic views showing the position checking procedure.
Figure 3B:
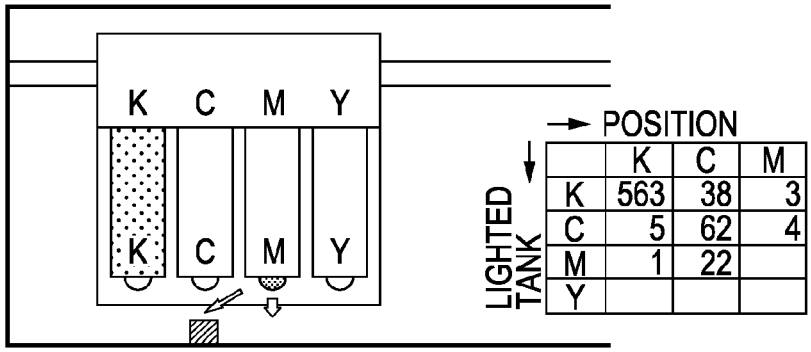
Figure 3C:
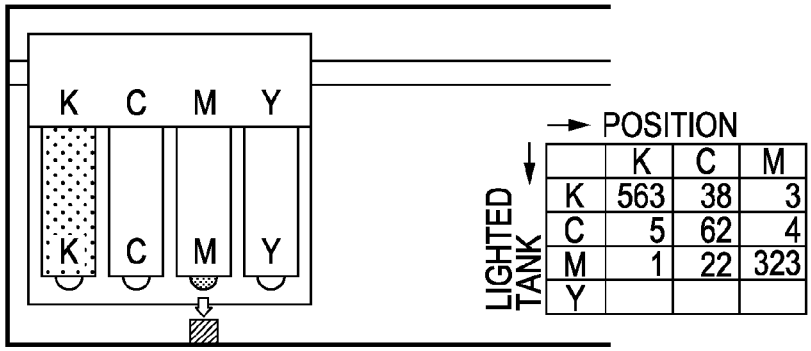
Figure 4A:
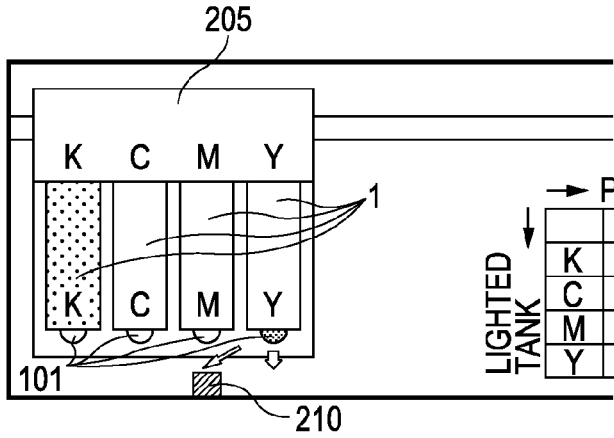
FIGS. 4A, 4B, and 4C are schematic views showing the position checking procedure.
Figure 4B:
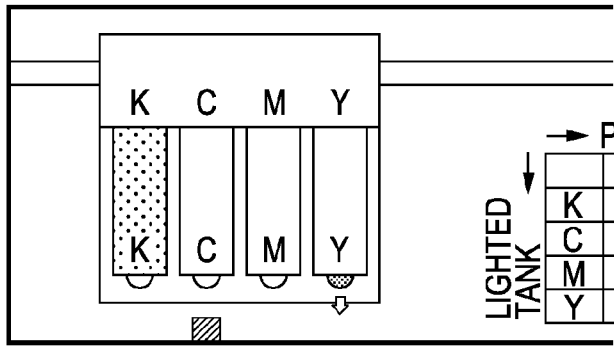
Figure 4C:
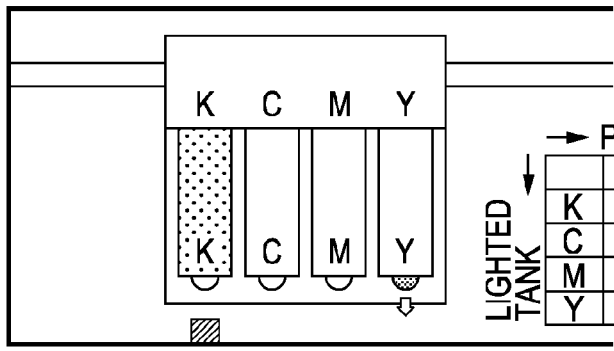

FIGS. 2, 3, and 4 are schematic views showing cases in which the above-described operation is sequentially performed in a state in which the LED of the cyan ink tank 1C is turned on, a state in which the LED of the magenta ink tank 1M is turned on, and a state in which the LED of the yellow ink tank 1Y is turned on.

Tables in the figures show the relationship between the lighted ink tank and the amount of light received by the light receiver at the respective ink tank positions. Even when the same current is passed by the same circuit, the amount of emitted light varies among a plurality of LEDs of the ink tanks because of manufacturing error. Consequently, this sometimes leads to variations among the LEDs 101 attached to the ink tanks 1. Further, the light guide characteristic varies among the light guides of the ink tanks because of manufacturing error, and the amount of light guided in the light guides is sometimes reduced. In addition, soil, such as ink mist, sticks to the ink tanks 1 because of differences in replacement frequency of the ink tanks 1, and this sometimes reduces the amount of emitted light. For this reason, the amount of emitted light sometimes varies among the ink tanks 1. In the tables, for example, when the black ink tank 1K is turned on and placed at a position such as to face the light receiver 210, the amount of light received by the light receiver 210 is about 563 mV. In contrast, when the cyan ink tank 1C is turned on and placed at a position such as to face the light receiver 210, the amount of received light is about 62 mV, which is about one-ninth of the amount of light in the above case. These ink tanks are used as an example in the first embodiment for the above-described reasons.

Even when the lighted ink tank does not face the light receiver 210, the amount of light received by the light receiver 210 does not become zero in most cases. This is because light leaking from the lighted ink tank is diffused, is reflected by the other ink tanks, and then reaches the light receiver 210. The amount of leakage light can be reduced by attaching a guide to the light receiver 210 to increase directivity or improving the shape or color of the ink tank. In the first embodiment, the amount of light received at a position where the light receiver 210 faces the lighted ink tank is about 15 times of the amount of light received at a position where the light receiver 210 faces the ink tank adjacent to the lighted ink tank.

A method for checking the positions of the ink tanks 1 will now be described. Data corresponding to the tables is stored in the memory of the printer 200, and the positions are checked on the basis of the data. First, the position of the black ink tank 1K is checked. The position, where the largest amount of light is received by the light receiver 210 when the LED 101 of the black ink tank 1K is turned on, is found. The amount of light at the black position K is about 563 mV, which is the largest. Therefore, it is determined that the black ink tank 1K is placed at the black position K. In this way, when the color of the lighted ink tank coincides with the color of the position in the carriage 205 where the amount of received light is the largest, it is determined that the ink tank is mounted at a correct position. Similarly, it is possible to determine that the cyan ink tank 1C is mounted at the cyan position C by finding the position where the amount of light received from the LED 101 of the cyan ink tank 1C is the largest.

Through the above-described procedure, the mounting states of the black ink tank 1K and the cyan ink tank 1C other than the yellow ink tank 1Y, which should be mounted at the yellow position Y that does not face the light receiver 210, and the magenta ink tank 1M, which should be mounted at the magenta position M adjacent to the yellow position Y, are checked. When it is determined that both ink tanks 1K and 1C are properly mounted, a process for checking the positions of the magenta ink tank 1M and the yellow ink tank 1Y is performed. First, the position, where the largest amount of light is received by the light receiver 210 when the LED 101 of the magenta ink tank 1M is turned on, is found. The amount of received light is about 323 mV, that is, the largest at the magenta position M. Subsequently, the ink tank, which provides the largest amount of received light when the light receiver 210 faces the magenta position M, is found. The amount of received light is the largest when the LED 101 of the magenta ink tank 1M is turned on. This shows that the magenta ink tank 1M is mounted at the magenta position M, and therefore, the yellow ink tank 1Y is mounted at the remaining yellow position Y. Consequently, it is determined that all the ink tanks 1 are mounted at their correct positions.

Next, a method for checking the ink tanks that are mounted at wrong positions will be described. A position checking procedure shown in FIGS. 5 to 8 serving as schematic views is different from the position checking procedure shown in FIGS. 1 to 4 in that the mounting positions of the yellow ink tank 1Y and the magenta ink tank 1M are reversed. That is, the yellow ink tank 1Y is mounted at the magenta position M, and the magenta ink tank 1M is mounted at the yellow position Y. The steps shown in FIGS. 5A to 8C are performed sequentially.

Figure 5A:
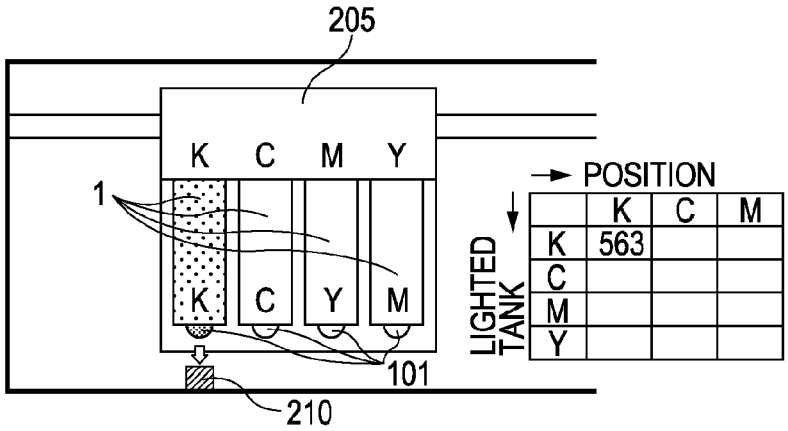
FIGS. 5A, 5B, and 5C are schematic views showing the position checking procedure.
Figure 5B:
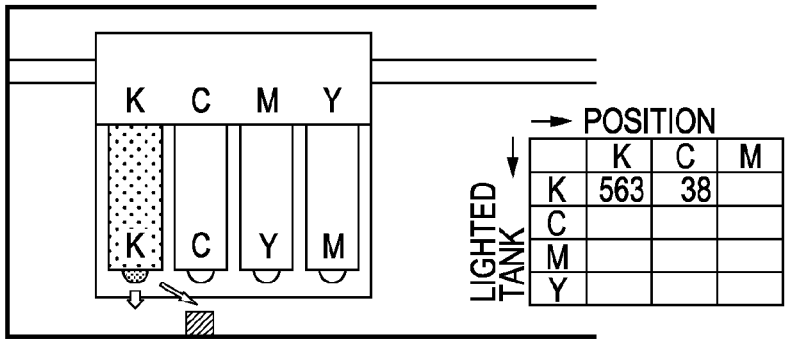
Figure 5C:
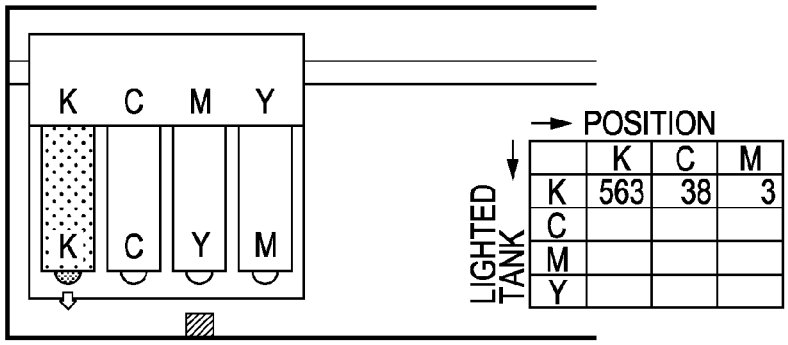

As shown in FIGS. 5A to 5C, the LED 101 of the black ink tank 1K is first turned on. In FIG. 5A, the black ink tank 1K faces the light receiver 210, and the amount of light received by the light receiver 210 is about 563 mV. In the state shown in FIG. 5B, the carriage 205 is moved to the left along the guide shaft 207 by a distance corresponding to one ink tank, and the light receiver 201 faces the cyan ink tank 1C. In this case, since the LED 101 of the black ink tank 1K is turned on, the amount of light that reaches the light receiver 210 is about 38 mV, which is smaller than when the black ink tank 1K faces the light receiver 210. In the state shown in FIG. 5C, the carriage 205 is further moved to the left by a distance corresponding to one ink tank, and the light receiver 210 faces the yellow ink tank 1Y mounted at the magenta position M. In this case, the amount of light received by the light receiver 210 is further reduced to about 3 mV.

Figure 6A:
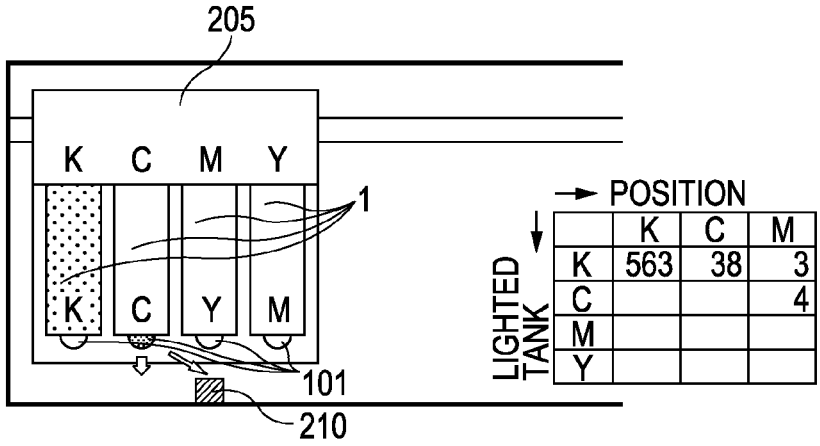
FIGS. 6A, 6B, and 6C are schematic views showing the position checking procedure.
Figure 6B:
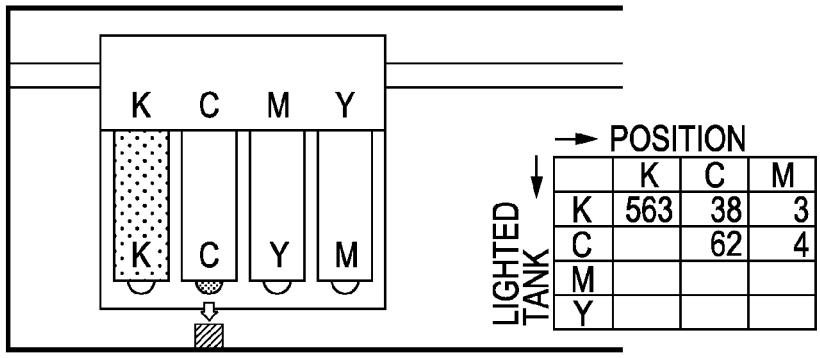
Figure 6C:
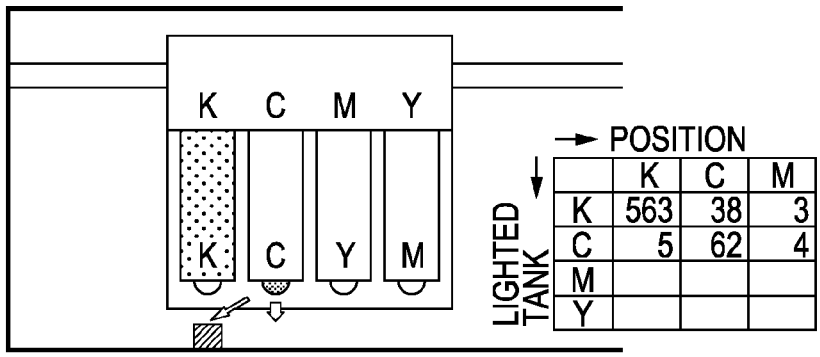

In FIGS. 6A to 6C, the LED 101 of the cyan ink tank 1C is turned on. In the state shown in FIG. 6A, the light receiver 210 faces the yellow ink tank 1Y mounted at the magenta position M, and the amount of light received by the light receiver 210 is about 4 mV. In the state shown in FIG. 6B, the carriage 205 is moved to the right by a distance corresponding to one ink tank, and the light receiver 210 faces the cyan ink tank 1C. In this case, the amount of light received by the light receiver 210 is about 62 mV. In FIG. 6C, the light receiver 210 faces the black ink tank 1K. In this case, the amount of received light is about 5 mV.

Figure 7A:
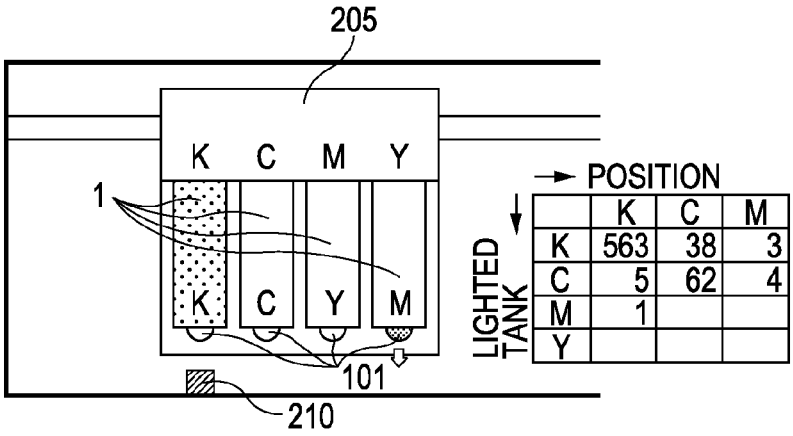
FIGS. 7A, 7B, and 7C are schematic views showing the position checking procedure.
Figure 7B:
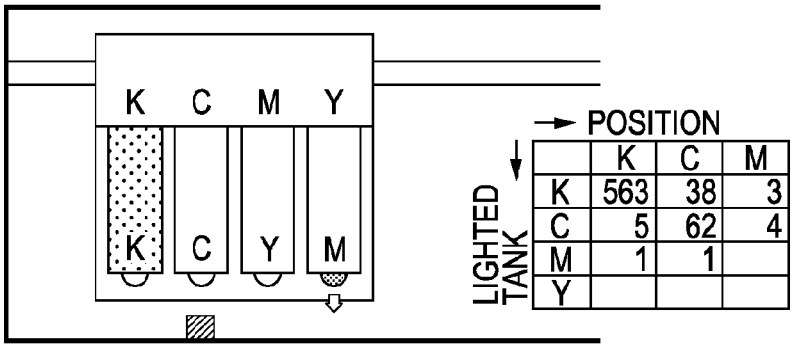
Figure 7C:
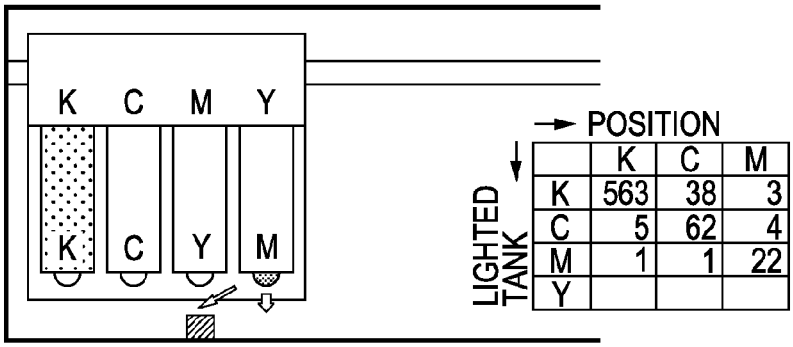

In FIGS. 7A to 7C, the LED 101 of the magenta ink tank 1M is turned on. In FIG. 7A, the light receiver 210 faces the black ink tank 1K, and the amount of light received by the light receiver 210 is about 1 mV. In the state shown in FIG. 7B, the carriage 205 is moved to the left along the guide shaft 207 by a distance corresponding to one ink tank, and the light receiver 210 faces the cyan ink tank 1C. In this case, the amount of light received by the light receiver 210 is about 1 mV. In the state shown in FIG. 7C, the carriage 205 is further moved to the left by a distance corresponding to one ink tank, and the light receiver 210 faces the yellow ink tank 1Y mounted at the magenta position M. In this case, the amount of received light is about 22 mV.

Figure 8A:
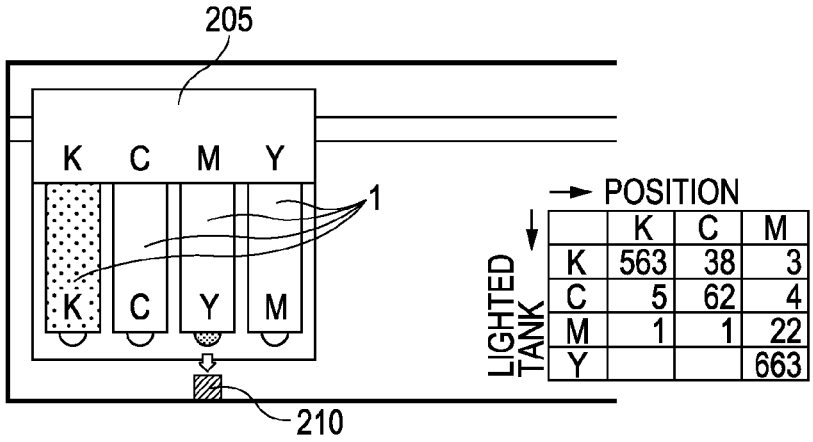
FIGS. 8A, 8B, and 8C are schematic views showing the position checking procedure.
Figure 8B:
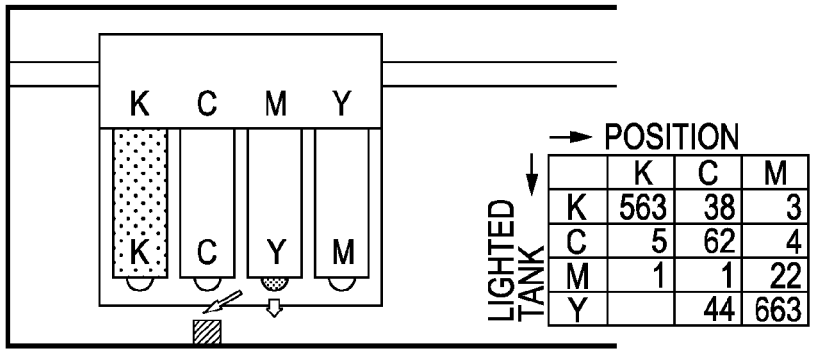
Figure 8C:
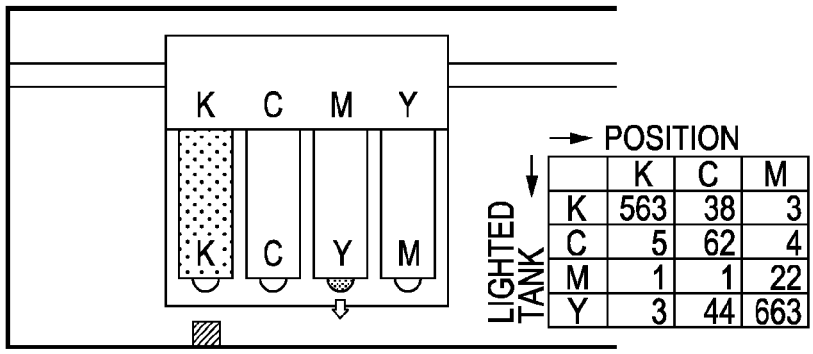

The steps shown in FIG. 8A to 8C are similarly performed to acquire data on the amount of received light. Then, the positions of the ink tanks are checked.

First, the position of the black ink tank 1K is checked. The position, where the largest amount of light is received by the light receiver 210 when the LED 101 of the black ink tank 1K is turned on, is found. The amount of received light is about 563 mV, that is, the largest at the black position K. Therefore, it is determined that the black ink tank 1K is mounted at the black position K. Similarly, when the LED 101 of the cyan ink tank 1C is turned on, the amount of light received by the light receiver 210 is about 62 mV at the cyan position C, which is the largest. Therefore, it is determined that the cyan ink tank 1C is properly mounted at the cyan position C.

Through the above-described procedure, it is determined that the black ink tank 1K and the cyan ink tank 1C other than the yellow ink tank 1Y, which should be mounted at the yellow position Y that does not face the light receiver 210, and the magenta ink tank 1M, which should be mounted at the magenta position M adjacent to the yellow position Y, are mounted properly. Subsequently, the positions of the remaining magenta and yellow ink tanks 1M and 1Y are checked. First, the position, where the largest amount of light is received by the light receiver 210 when the LED 101 of the magenta ink tank 1M is turned on, is found. The amount of received light at the magenta position M is about 22 mV, which is the largest. Subsequently, the ink tank, which provides the largest amount of received light when the light receiver 210 faces the magenta position M, is found. The amount of received light is the largest when the LED 101 of the yellow ink tank 1Y is turned on. This shows that the magenta ink tank 1M is not mounted at the magenta position M. That is, it is determined that the yellow ink tank 1Y is mounted at the magenta position M, and the magenta ink tank 1M is mounted at the yellow position Y.

Second Embodiment

A position checking method using ink tanks and a printer similar to those in the first embodiment will now be described as a second embodiment with reference to FIGS. 9 to 14.

In the second embodiment, only a yellow position Y cannot face a light receiver 210, in a manner similar to that in the first embodiment.

Figure 9A:
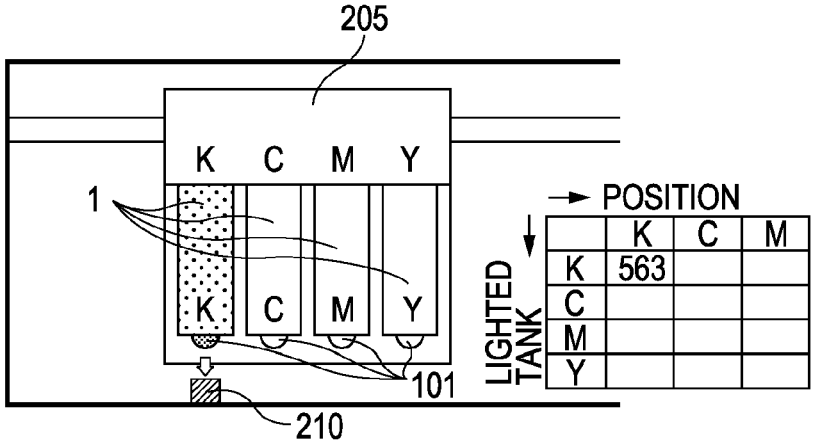
FIGS. 9A and 9B are schematic views showing a position checking procedure according to a second embodiment of the present invention.
Figure 10A:
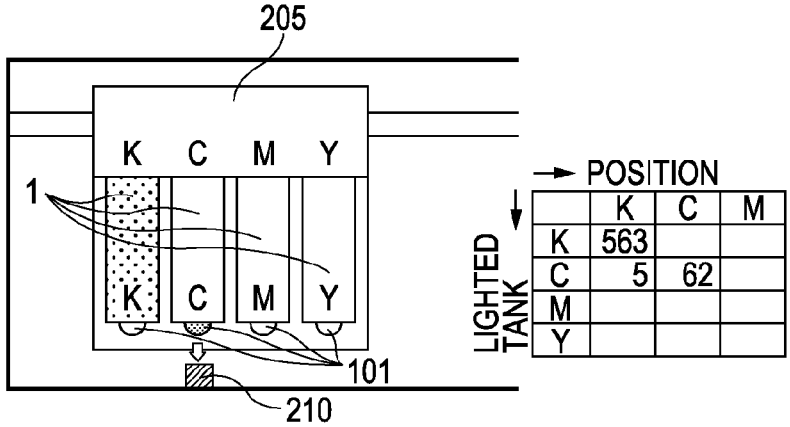
FIGS. 10A, 10B, and 10C are schematic views showing the position checking procedure.
Figure 10B:
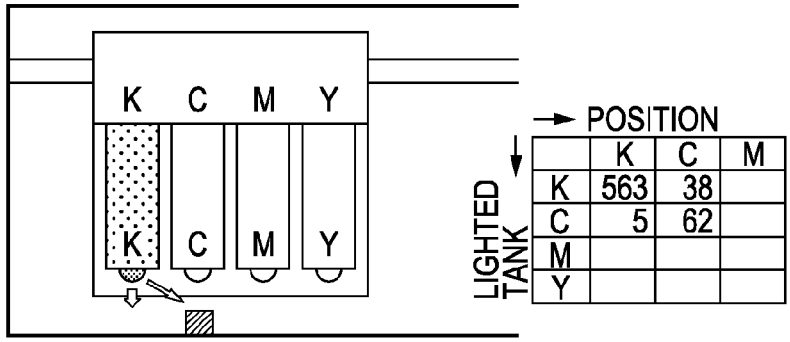
Figure 10C:
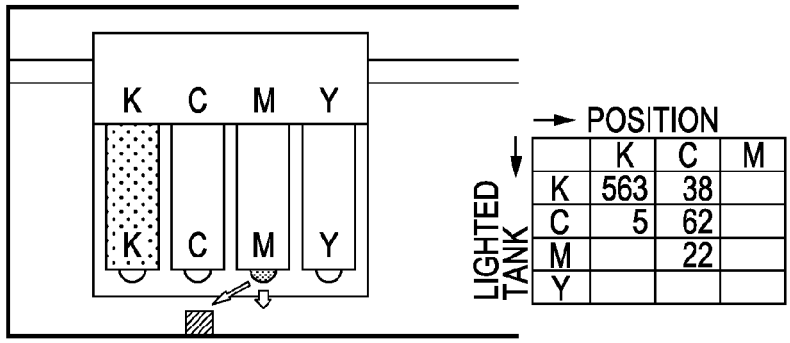
Figure 11A:
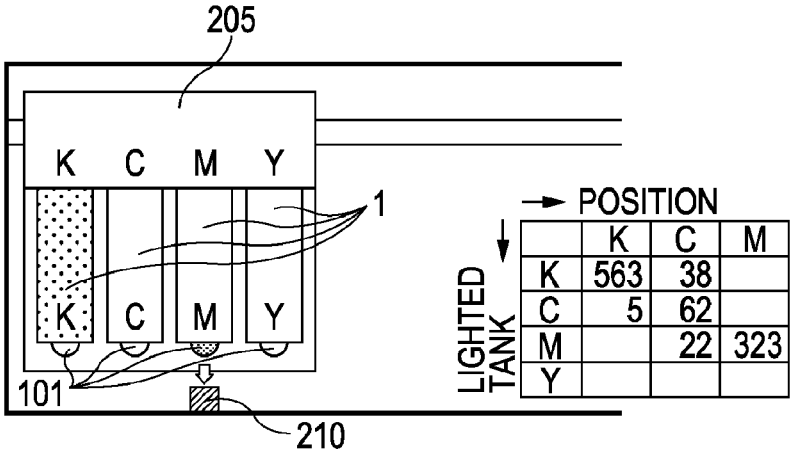
FIGS. 11A, 11B, and 11C are schematic views showing the position checking procedure.
Figure 11B:
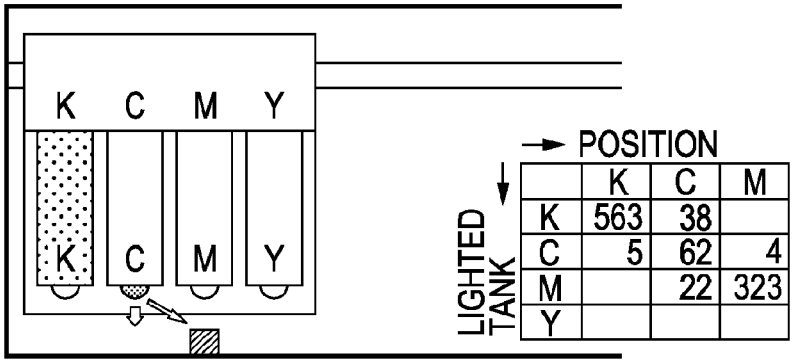
Figure 11C:
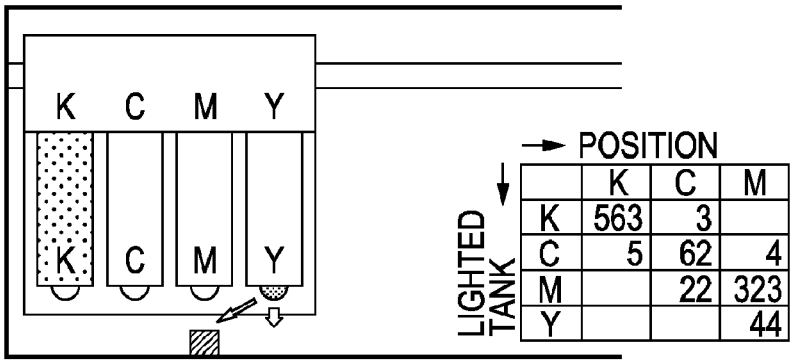
Figure 12A:
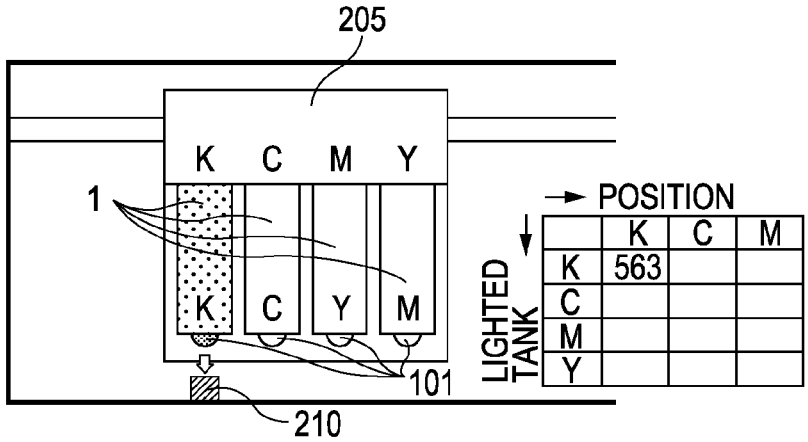
FIGS. 12A and 12B are schematic views showing the position checking procedure.

FIGS. 9 to 11 are schematic views showing a position checking procedure performed when the ink tanks are mounted at correct positions. The steps shown in FIGS. 9A to 11C are performed sequentially. FIGS. 12 to 14 are schematic views showing a position checking procedure performed when the mounting positions of a yellow ink tank 1Y and a magenta ink tank 1M are reversed. That is, the yellow ink tank 1Y is mounted at a magenta position M, and the magenta ink tank 1M is mounted at a yellow position Y. Similarly to the above, the steps shown in FIG. 12A to FIG. 14C are performed sequentially.

Figure 9B:
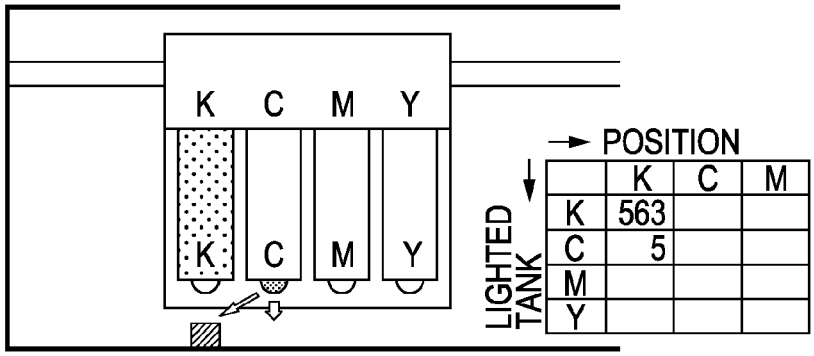

FIGS. 9A and 9B show states in which a carriage 205 is moved so that the light receiver 210 faces a black position K. In the state shown in FIG. 9A, an LED 101 of a black ink tank 1K is turned on, and the amount of light received by the light receiver 210 is about 563 mV. In the state shown in FIG. 9B, the LED 101 of the black ink tank 1K is turned off, and an LED 101 of a cyan ink tank 1C is turned on. In this case, the amount of light received by the light receiver 210 is about 5 mV.

FIGS. 10A to 10C show states in which the carriage 205 is moved to the left by a distance corresponding to one ink tank, that is, the light receiver 210 faces a cyan position C. In the state shown in FIG. 10A, the carriage 205 is moved without turning off the LED 101 of the cyan ink tank 1C that has been turned on in FIG. 9B. In this case, the amount of light received by the light receiver 210 is about 62 mV. In the state shown in FIG. 10B, the carriage 205 is not moved, the LED 101 of the cyan ink tank 1C is turned off, and the LED 101 of the black ink tank 1K is turned on. In this case, the amount of light received by the light receiver 210 is 38 about mV. In the state shown in FIG. 10C, the LED 101 of the black ink tank 1K is turned off, and an LED 101 of the magenta ink tank 1M is turned on. In this case, the amount of light received by the light receiver 210 is 22 about mV.

In FIGS. 11A to 11C, the carriage 205 is moved to the left by a distance corresponding to one ink tank, in a manner similar to the above, and the LEDs of the adjacent ink tanks are alternately turned on. Consequently, the amount of light received by the light receiver 210 placed in front of the ink tank mounted at a proper position and the amounts of received light obtained at the positions on both sides of the above proper position (only one position on the outermost side) are stored as data in the memory of the printer. The mounting positions of the ink tanks are checked on the basis of the data. According to tables in FIGS. 11A to 11C that are obtained by the above procedure, for example, the mounting position of the cyan ink tank 1C is checked. When the LED 101 of the cyan ink tank 1C is turned on, the amount of received light is 62 mV when the light receiver 210 faces the cyan position C, about 5 mV when the light receiver 210 faces the black position K, and about 4 mV when light receiver 210 faces the magenta position M. By comparing these values, it is found that the amount of received light is the largest at the cyan position C. Therefore, it is determined that the cyan ink tank 1C is mounted properly.

When each of the black ink tank 1K and the cyan ink tank 1C is mounted at a proper position in this way, the amount of received light at the proper position is larger than the amounts of received light at the positions on both sides of the proper position (only one position on the outermost side), that is, the amount of received light at the proper position is the largest. From this, it can be determined that the ink tank is mounted properly.

When each of the yellow ink tank 1Y and the magenta ink tank 1M is mounted at a proper position, all the amounts of received light in front of and on both sides of the proper position cannot be detected. When it is determined that the other ink tanks, namely, the black ink tank 1K and the cyan ink tank 1C are properly mounted, the positions of the yellow ink tank 1Y and the magenta ink tank 1M are checked. First, the mounting position of the magenta ink tank 1M is checked. Referring to the tables, in a case in which the LED of the magenta ink tank 1M is turned on, the amount of received light is about 22 mV when the light receiver 210 faces the cyan position C, and about 323 mV when the light receiver 210 faces the magenta position M. That is, the amount of received light is the largest at the magenta position M. This value is larger than 44 mV that is received by the light receiver 210 at the magenta position M when the LED of the yellow ink tank 1Y is turned on, that is, the amount of received light is larger when LED of the magenta ink tank 1M is turned on. This shows that the magenta ink tank 1M is mounted at the magenta position M. Therefore, it is determined that the yellow ink tank 1Y is mounted at the remaining yellow position Y, and that all the ink tanks are mounted properly.

A description will now be given of a position checking procedure performed when the positions of the yellow ink tank 1Y and the magenta ink tank 1M are reversed, that is, the yellow ink tank 1Y is mounted at the magenta position M and the magenta ink tank 1M is mounted at the yellow position Y.

Figure 12B:
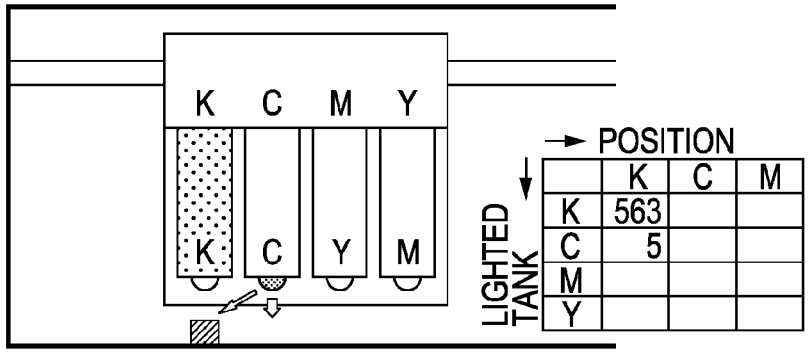

FIGS. 12A and 12B show states in which the carriage 205 is moved so that the light receiver 210 faces the black position K. In the state shown in FIG. 12A, the LED of the black ink tank 1K is turned on, and the amount of light received by the light receiver 210 is about 563 mV. In the state shown in FIG. 12B, the LED of the black ink tank 1K is turned off, and the LED of the cyan ink tank 1C is turned on. In this case, the amount of received light is about 5 mV.

Figure 13A:
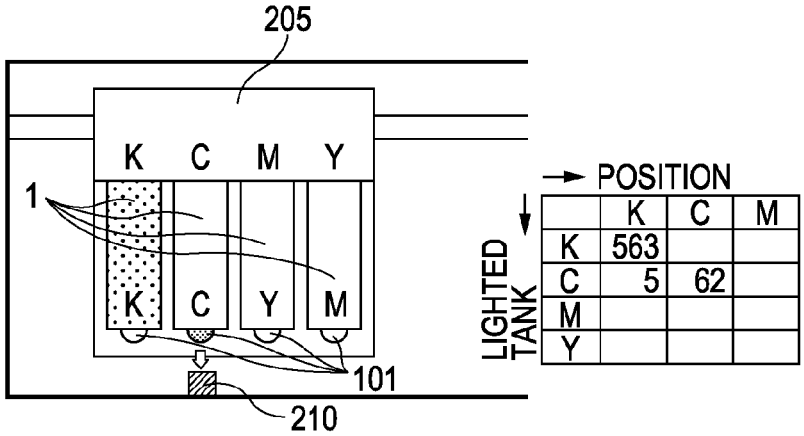
FIGS. 13A, 13B, and 13C are schematic views showing the position checking procedure.
Figure 13B:
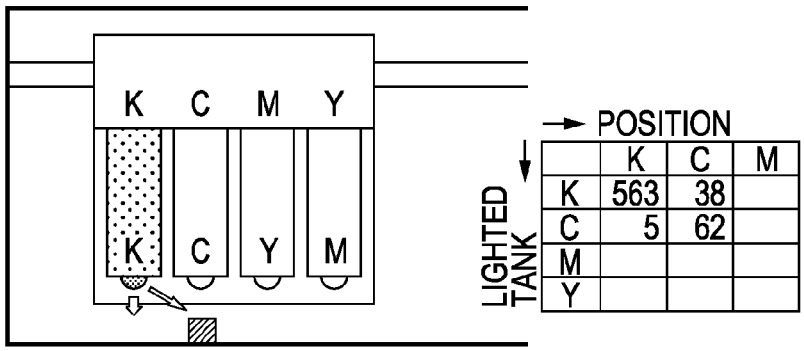
Figure 13C:
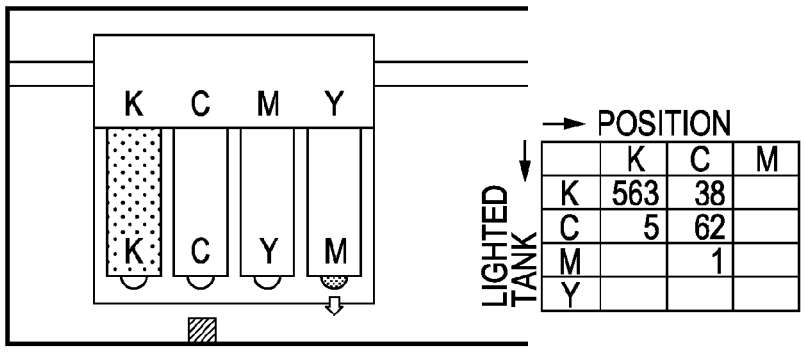

FIGS. 13A to 13C show states in which the carriage 205 is moved to the left by a distance corresponding to one ink tank, that is, the light receiver 210 faces the cyan position C. In the state shown in FIG. 13A, the carriage 205 is moved without turning off the LED of the cyan ink tank 1C that has been turned on in FIG. 12B, and therefore, the LED of the cyan ink tank 1C remains lighted. In this case, the amount of received light is about 62 mV. In the state shown in FIG. 13B, the LED of the cyan ink tank 1C is turned off, and the LED of the black ink tank 1K is turned on. In the state shown in FIG. 13C, the LED of the black ink tank 1K is turned off, and the LED of the magenta ink tank 1M is turned on. However, since the magenta ink tank 1M is improperly mounted at the yellow position Y, the amount of light received by the light receiver 210 at the cyan position is about 1 mV, which is smaller than the amount of 22 mV obtained when the magenta ink tank 1M is mounted at the magenta position M.

Figure 14A:
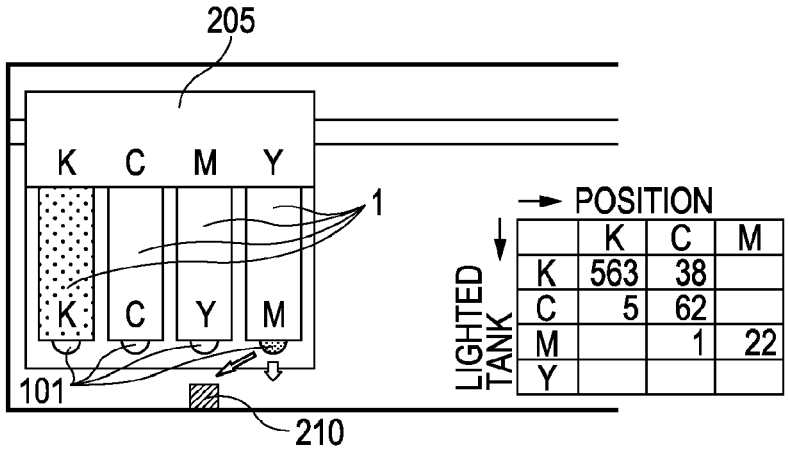
FIGS. 14A, 14B, and 14C are schematic views showing the position checking procedure.
Figure 14B:
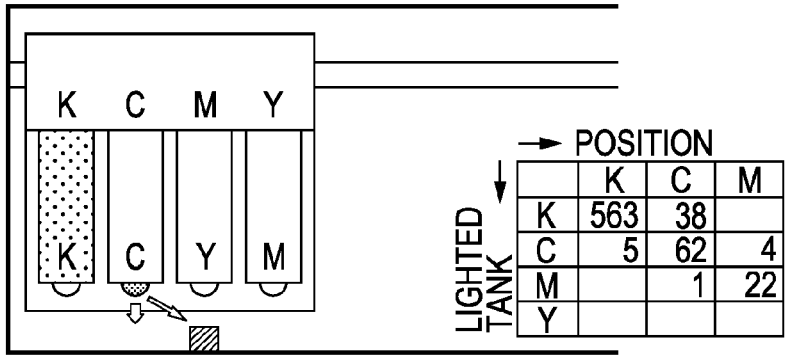
Figure 14C:
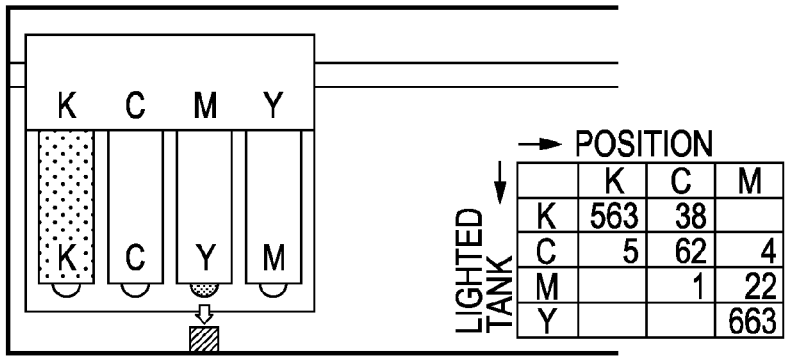

In FIGS. 14A to 14C, the carriage 205 is further moved to the left by a distance corresponding to one ink tank, and the LEDs of the ink tanks adjacent to the ink tank mounted at a proper position are alternately turned on, in a manner similar to the above. By the above-described procedure, it is similarly checked that the black ink tank 1K and the cyan ink tank 1C are mounted at proper positions. Then, the mounting position of the magenta ink tank 1M is checked. As shown in the tables of the figures, in a case in which the light receiver 210 faces the magenta position M, the amount of received light is about 22 mV when the LED of the magenta ink tank 1M is turned on, and is about 663 mV when the LED of the yellow ink tank 1Y is turned on. The amount of light obtained when the LED of the magenta ink tank 1M is turned on should be larger than when the LED of the yellow ink tank 1Y is turned on. However, in actuality, the amount of light obtained when the LED of the magenta ink tank 1M is turned on is smaller than when the LED of the yellow ink tank 1Y is turned on. This shows that the magenta ink tank 1M is improperly mounted. In this way, the amount of received light at one of the positions corresponding to the ink tanks obtained when the LEDs of the ink tanks are turned on are compared. When the amount of received light obtained at the tank position when the LED of the ink tank, which should be mounted at the tank position, is turned on is not larger than the amount obtained when the LED of the other ink tank is turned on, improper mounting can be detected. Therefore, even when the amounts of received light in front of and on both sides of the positions where the yellow ink tank 1Y and the magenta ink tank 1M are properly mounted cannot be detected, it can be checked that the ink tanks are not mounted at proper positions.

In the second embodiment, the positions of all the ink tanks can be checked only during the movement of the carriage 205 in one direction. This can reduce the time from when the ink tank is replaced to when the printer is restarted.

While the position checking method for the printer in which four ink tanks corresponding to four colors are mounted have been described in the first and second embodiments, the number of colors is not limited to four. The above-described position checking method is also applicable to a printer in which ink tanks corresponding to five or more colors are mounted.

Third Embodiment

A position checking method according to a third embodiment of the present invention will be described with reference to FIGS. 21 to 26. In the third embodiment, a gray ink tank 1G is added to the ink tanks 1K, 1C, 1M, and 1Y mounted in the recording head unit 105 of the printer of the first embodiment, thereby improving print quality.

In the third embodiment, positions at both ends, that is, a black position K and a gray position G are not moved so as to face a light receiver 210.

FIGS. 21 to 23 are schematic views showing a position checking procedure performed when all ink tanks are mounted at proper positions. The steps shown in FIGS. 21A to 23D are performed sequentially. FIGS. 24 to 26 are schematic views showing a position checking procedure performed when the mounting positions of a gray ink tank 1G and a black ink tank 1K are reversed, that is, the gray ink tank 1G is mounted at the black position K and the black ink tank 1*k* is mounted at the gray position G. Similarly, the steps shown in FIGS. 24A to 26D are performed sequentially.

FIGS. 21A to 21D show states in which a carriage 205 is moved so that the light receiver 210 faces a cyan position C. In the state shown in FIG. 21A, an LED 101 of a cyan ink tank 1C is turned on, and the amount of light received by the light receiver 210 is about 124 mV. In the state shown in FIG. 21B, the LED 101 of the cyan ink tank 1C is turned off, and an LED 101 of the black ink tank 1K is turned on. In this case, the amount of light received by the light receiver 210 is about 38 mV. In the state shown in FIG. 21C, the LED 101 of the black ink tank 1C is turned off, and an LED 101 of a magenta ink tank 1M is turned on. In this case, the amount of received light is about 22 mV. In the state shown in FIG. 21D, the LED 101 of the magenta ink tank 1M is turned off, and an LED 101 of the gray ink tank 1G is turned on. In this case, the amount of received light is about 1 mV.

Figure 22A:
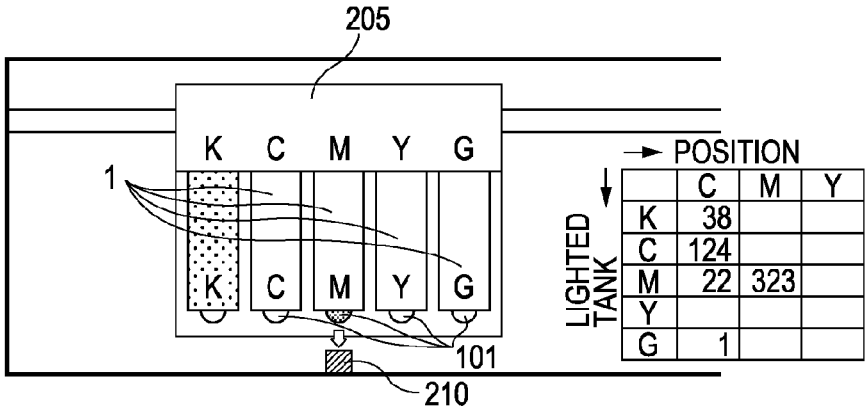
FIGS. 22A, 22B, and 22C are schematic views showing the position checking procedure.
Figure 22B:
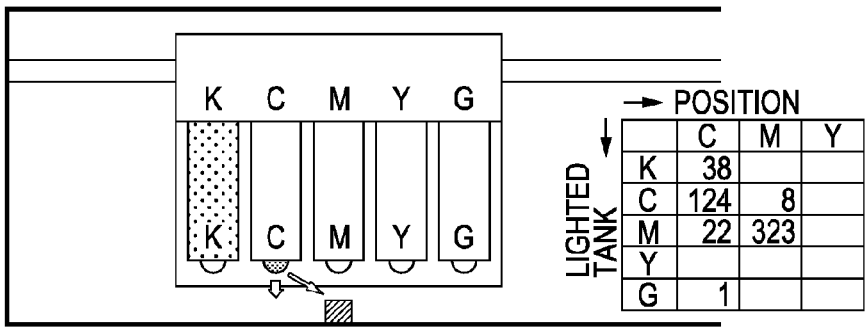
Figure 22C:
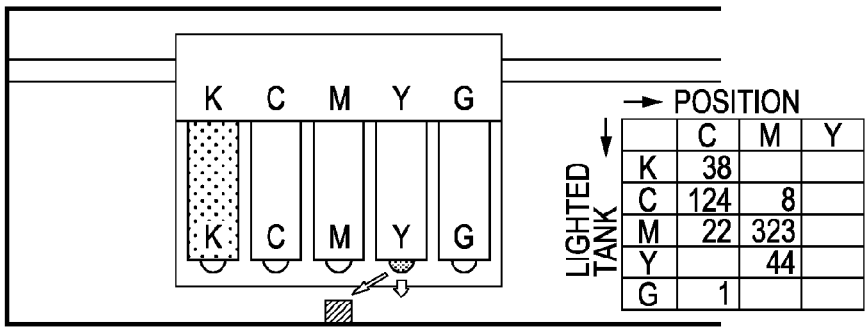
Figure 23A:
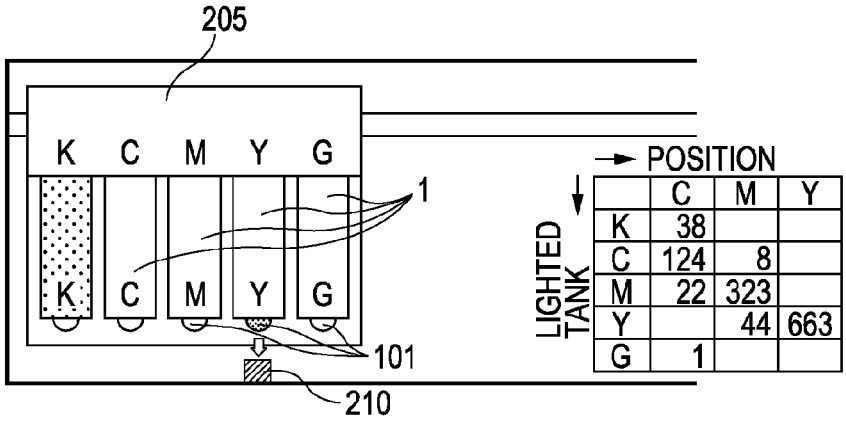
FIGS. 23A, 23B, 23C, and 23D are schematic views showing the position checking procedure.
Figure 23B:
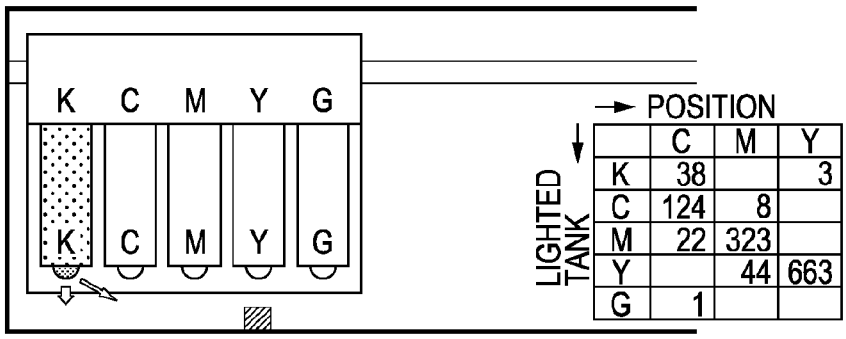
Figure 23C:
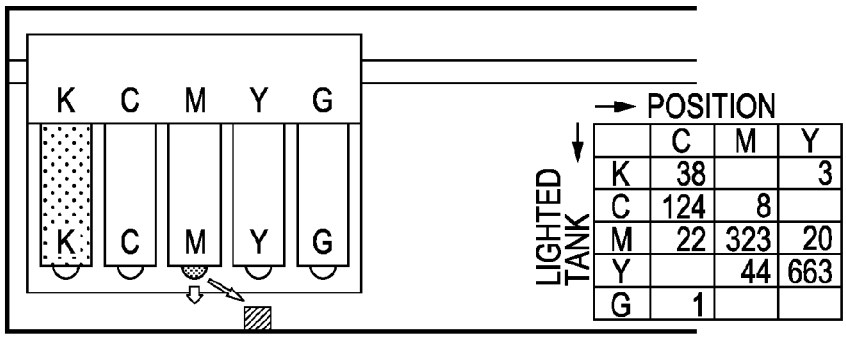
Figure 23D:
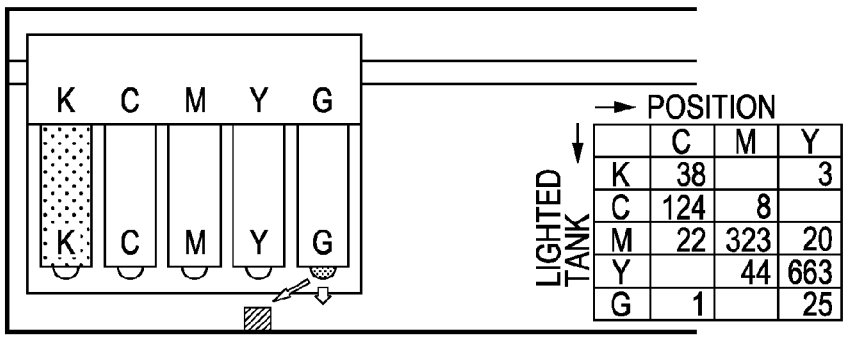
Figure 24A:
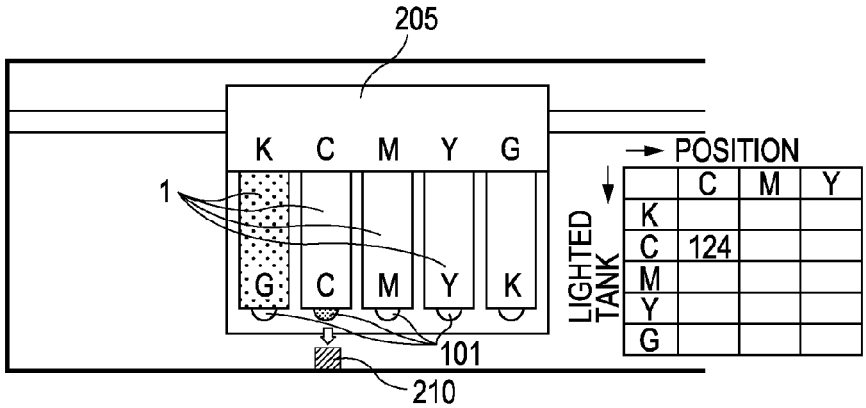
FIGS. 24A, 24B, 24C, and 24D are schematic views showing the position checking procedure.
Figure 24B:
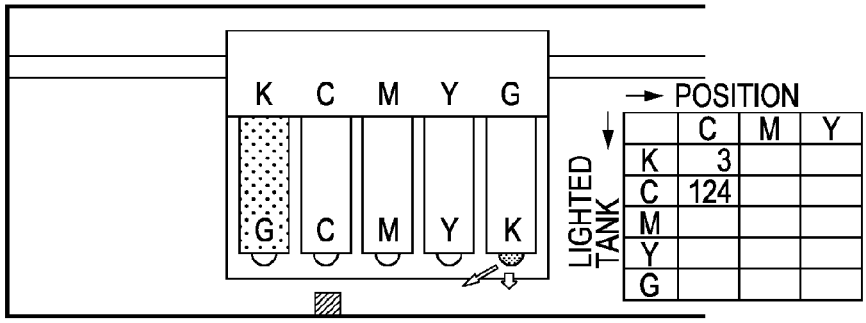
Figure 24C:
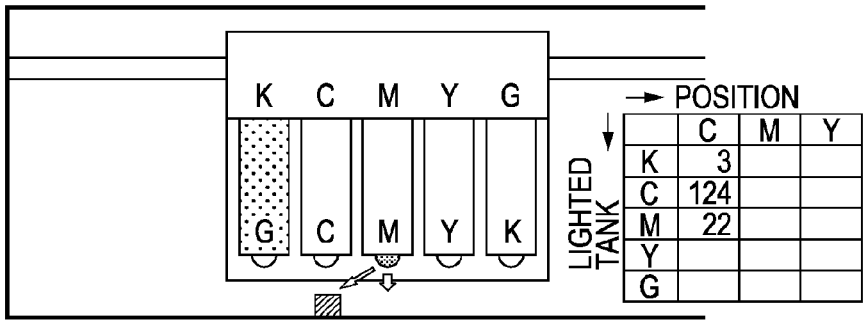
Figure 24D:
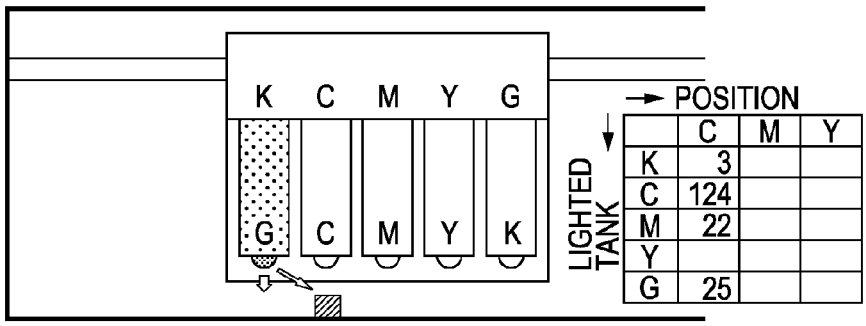

In FIGS. 22A to 22C, the carriage 205 is moved to the left by a distance corresponding to one ink tank, in a manner similar to that in the above-described embodiment, and the LEDs of the ink tanks are turned on sequentially. The amount of light received by the light receiver 210 placed in front of the ink tank mounted at a proper position, and the amounts of received light obtained at the positions on both sides of the above proper position (only one position on the outermost side) are stored as data in the memory of the printer. As for the ink tanks mounted at both sides of the carriage 205, the amount of received light obtained at the position adjacent to the position where each of the ink tanks should be mounted and the amount of received light obtained at the position adjacent to the position on the opposite side are stored as data in the memory of the printer.

The mounting positions of the ink tanks are checked on the basis of the data. Checking is performed according to tables that are obtained by the above procedure. For example, in a case in which the LED 101 of the magenta ink tank 1M is turned on, the amount of received light is about 323 mV when the light receiver 210 faces the magenta position M, about 22 mV when the light receiver 210 faces the cyan position C, and about 20 mV when the light receiver 210 faces the yellow position Y. By comparing these values, it is found that the amount of received light is the largest at the magenta position M. Therefore, it is determined that the magenta ink tank 1M is mounted properly.

When each of the cyan ink tank 1C and the yellow ink tank 1Y is mounted at a proper position, the amount of received light cannot be detected at both sides of the proper position. When it is determined that the magenta ink tank 1M is mounted properly, the positions of the cyan ink tank 1C and the yellow ink tank 1Y are checked. First, the position of the cyan ink tank 1C is checked. The tables of the figures show that the amount of received light at the cyan position C is about 124 mV when the LED of the cyan ink tank 1C is turned on, and is about 8 mV at the magenta position M. That is, the amount of received light is larger at the cyan position C than at the magenta position M. The amount of light received by the light receiver 210 at the cyan position C is about 38 mV when the LED of the black ink tank 1K, which should be mounted on the outermost side, is turned on, and is about 1 mV when the LED 101 of the gray ink tank 1G, which also should be mounted on the outermost side, is turned on. In this case, the amount of received light at the cyan position C is also larger when the LED of the cyan ink tank 1C is turned on. This shows that the cyan ink tank 1C is mounted at the cyan position C. Similarly, this shows that the yellow ink tank 1Y is mounted at the yellow position Y.

After it is determined that the cyan ink tank 1C, the magenta ink tank 1M, and the yellow ink tank 1Y are mounted at correct positions, the positions of the remaining black and gray ink tanks 1K and 1G are checked. As shown in the tables in the figures, the amount of light received by the light receiver 210 facing the cyan position C is about 38 mV when the LED of the black ink tank 1K is turned on, which is larger than 1 mV obtained at the same position when the LED of the gray ink tank 1G is turned on. The amount of light received by the light receiver 210 facing the yellow position Y is about 25 mV when the LED of the gray ink tank 1G is turned on, and is larger than 3 mV obtained at the same position when the LED of the black ink tank 1K is turned on. From these results, it is determined that the black ink tank 1K and the gray ink tank 1G are mounted at proper positions, and that all the ink tanks are mounted properly.

Of course, the amount of light received by the light receiver when the light emitter faces the position adjacent to the light receiver is always smaller than when the light emitter faces the light receiver, and is still smaller when the light emitter faces the position farther than the adjacent position.

The following methods are performed in order to achieve this system:

(1) LEDs to be attached to the ink tanks are screened so that a uniform amount of light is emitted from the LEDs.

(2) The intensity of light emitted from the LEDs is adjusted, for example, by PWM control according to information about the ranks of the LEDs and information about the usage history of the ink tanks.

(3) The load resistance of the light receiver 201 can be automatically adjusted according to the information about the ranks of the LEDs and the information about the usage history of the ink tanks.

A similar system can be achieved by standardizing the amount of received light by means of a combination of the above-described methods or other means.

A description will now be given of a position checking procedure performed when the mounting positions of the black ink tank 1K and the gray ink tank 1G are reversed, that is, the black ink tank 1K is mounted at the gray position G and the gray ink tank 1G is mounted at the black position K.

FIGS. 24A to 24D show states in which the carriage 205 is moved so that the light receiver 210 faces the cyan position C. In the state shown in FIG. 24A, the LED 101 of the cyan ink tank 1C is turned on, and the amount of light received by the light receiver 210 is about 124 mV. In the state shown in FIG. 24B, the LED 101 of the cyan ink tank 1C is turned off, and the LED 101 of the black ink tank 1K is turned on. In this case, the amount of light received by the light receiver 210 is about 3 mV. In the state shown in FIG. 24C, the LED 101 of the black ink tank 1K is turned off, and the LED 101 of the magenta ink tank 1M is turned on. In this case, the amount of received light is about 22 mV. In the state shown in FIG. 24D, the LED 101 of the magenta ink tank 1M is turned off, and the LED 101 of the gray ink tank 1G is turned on. In this case, the amount of received light is about 25 mV.

Figure 25A:
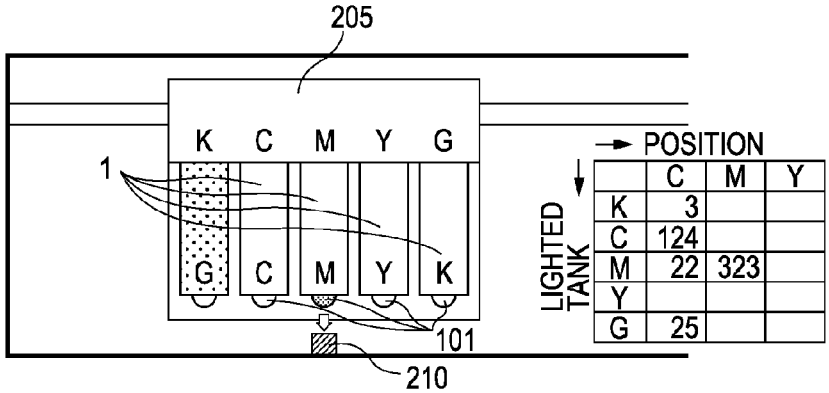
FIGS. 25A, 25B, and 25C are schematic views showing the position checking procedure.
Figure 25B:
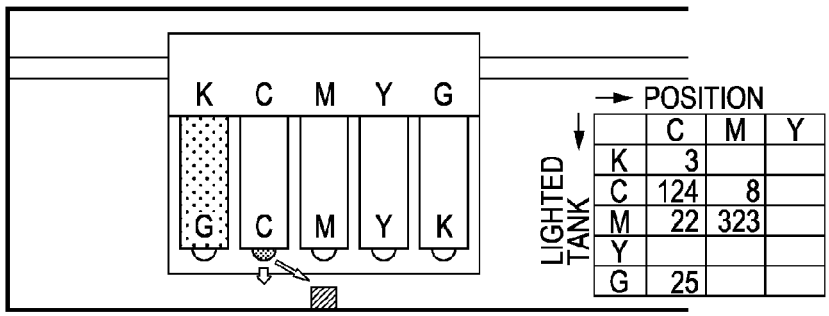
Figure 25C:
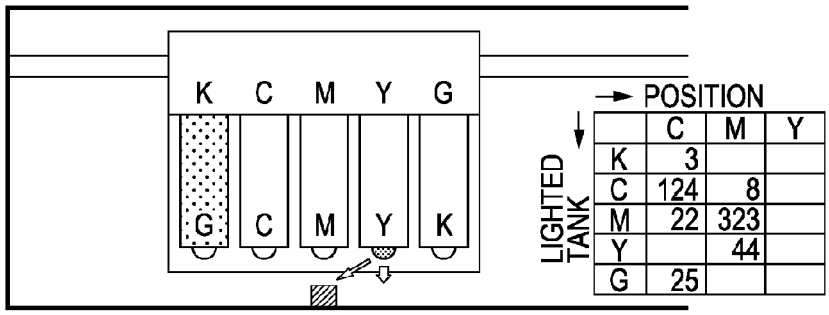
Figure 26A:
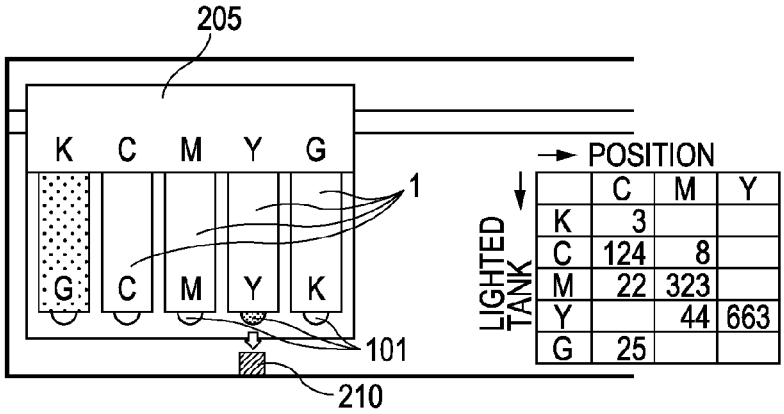
FIGS. 26A, 26B, 26C, and 26D are schematic views showing the position checking procedure.
Figure 26B:
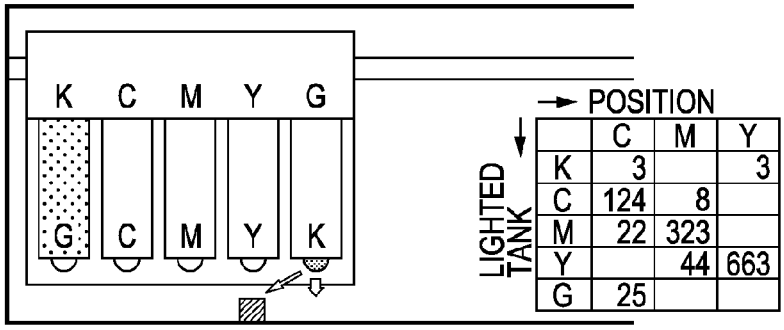
Figure 26C:
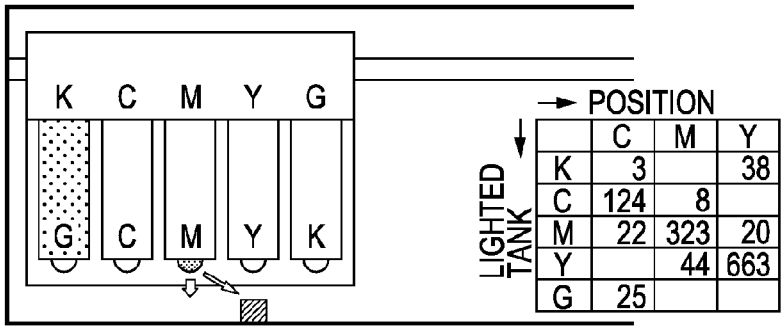
Figure 26D:
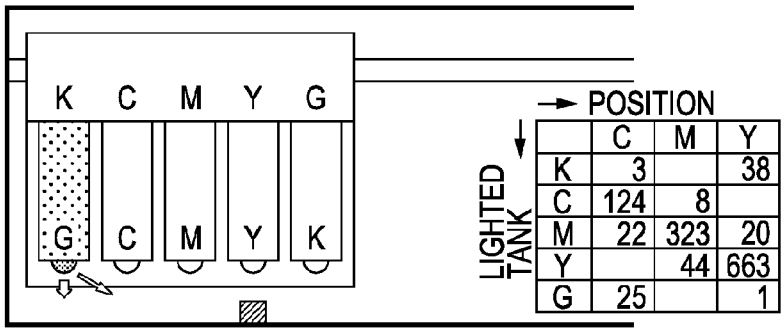

FIGS. 25A to 25C show states in which the carriage 205 is moved to the left in the figures by a distance corresponding to one ink tank, that is, in which the light receiver 210 faces the magenta position M. FIG. 25A shows a state in which the LED of the magenta ink tank 1M is turned on. In this state, the amount of light received by the light receiver 210 is about 323 mV. In the state shown in FIG. 25B, the LED of the magenta ink tank 1M is turned off, and the LED of the cyan ink tank 1C is turned on. In the state shown in FIG. 25C, the LED of the cyan ink tank 1C is turned off, and the LED of the yellow ink tank 1Y is turned on.

In FIGS. 26A to 26D, the carriage 205 is further moved to the left by a distance corresponding to one ink tank, similarly to the above, and the LEDs of the desired ink tanks are turned on alternately. By the above-described procedure, it is checked that the cyan ink tank 1C, the magenta ink tank 1M, and the yellow ink tank 1Y are similarly mounted at correct positions. Subsequently, the mounting positions of the black ink tank 1K and the gray ink tank 1G are checked. As shown in the tables of the figures, the amount of received light at the cyan position C is about 3 mV when the LED of the black ink tank 1K is turned on, and is about 25 mV when the LED of the gray ink tank 1G is turned on. The amount of light obtained when the LED of the black ink tank 1K is turned on should be larger than when the LED of the gray ink tank 1G is turned on. However, in actuality, the amount of light is smaller when the LED of the black ink tank 1K is turned on. This shows that the ink tanks 1K and 1G are improperly mounted.

As described above, even when the amounts of received light in front of proper positions where the ink tanks are mounted cannot be detected, it can be checked that the ink tanks are not mounted at the proper positions, by comparing the amounts of received light obtained at the position adjacent to the position of one of the ink tanks when the LEDs of the ink tanks are turned on.

In the third embodiment, the mounting positions of all the ink tanks are checked only during the movement of the carriage 205 in one direction, and the number of moving operations of the carriage 205 is smaller than in the first and second embodiments. Therefore, the time from when the ink tank is replaced to when the printer is restarted can be reduced.

While the position checking method of the above-described third embodiment is applied to the printer including the ink tanks corresponding to five colors, the number of colors is not limited to five. The position checking method is also applicable to a printer in which ink tanks corresponding to four, six, or more colors are mounted.

In the above-described method, even when some of the ink tanks cannot move to the positions facing the light receiver, or even when the positions are checked without moving the ink tanks, it is possible to check whether the ink tanks are mounted at correct positions.

Further, when the light-emitting time of the LEDs is shorter than the moving time of the carriage, the time taken to check the positions of the ink tanks can be reduced.

Fourth Embodiment

The printer 200 shown in FIG. 17 has an opening through which a recording medium supplied from the ASF 202 is ejected to the ejection tray 203. External light coming through the opening sometimes has an influence on a light receiver that receives light from light emitters of the ink tanks. In this case, the amounts of light received at the positions facing the ink tanks when the LEDs of all the ink tanks are turned off are stored in a memory such as a RAM (not shown) in the printer main unit. The amount of light received when the ink tanks are turned on are also stored in the RAM. The influence of external light can be prevented by subtracting the amount of received light in the non-lighting state from the amounts of received light in the lighting state.

In order to detect the amount of received light during the non-lighting state, the amount of received light are stored when each of the ink tanks faces the light receiver and when the LEDs of all the ink tanks are turned off. In this case, the ink tanks are not moved only to detect the amounts of received light in the non-lighting state. Therefore, there is no great influence on the operation time. Of course, even when the amount of received light are detected together before or after a series of steps in the above-described embodiments, similar advantages can be achieved.

As described in the above exemplary embodiments, a determination can be made whether a particular ink container is correctly or incorrectly mounted in a carriage of a recording apparatus. As part of this determination, the above exemplary embodiments also describe detecting the type or color of a particular ink tank.

While the present invention has been described with reference to the exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-180541 filed Jun. 21, 2005, which is hereby incorporated by reference herein in its entirety.

What is claimed is:

1. A printer comprising:

a first ink tank, a second ink tank, and a third ink tank each including a light emitting unit and a controller configured to control the light emitting unit;

a light receiving unit configured to receive light from the light emitting unit of each of the first, second and third ink tanks;

a carriage capable of being moved for scanning and including a first pocket configured to mount the first ink tank therein, a second pocket configured to mount the second ink tank therein, and a third pocket configured to mount the third ink tank therein, the carriage being structured such that the ink tanks are able to be mounted at wrong pockets; and a control circuit configured to determine whether an ink tank is mounted in a correct pocket;

wherein the first pocket is provided at the extremity of the carriage, the second pocket is provided adjacent to the first pocket and the third pocket is provided not adjacent to the first pocket, the first pocket not being able to be located at a position facing the light receiving unit, and the second and the third pockets being able to be located both at a position facing the light receiving unit and at a position not facing the light receiving unit in accordance with the movement of the carriage, and wherein, when the amount of light received by the light receiving unit in a case where the light receiving unit receives the light emitted by the light emitting unit of the second ink tank when the second pocket is located at the position not facing the light receiving unit is represented as A, the amount of light received by the light receiving unit in a case where the light receiving unit receives the light emitted by the light emitting unit of the second ink tank when the second pocket is located at the position facing the light receiving unit is represented as B, the amount of light received by the light receiving unit in a case where the light receiving unit receives the light emitted by the light emitting unit of the first ink tank when the second pocket is located at the position facing the light receiving unit is represented as C, the amount of light received by the light receiving unit in a case where the light receiving unit receives the light emitted by the light emitting unit of the third ink tank when the third pocket is located at the position_not facing the light receiving unit is represented as D, and the amount of light received by the light receiving unit in a case where the light receiving unit receives the light emitted by the light emitting unit of the third ink tank when the third pocket is located at the position facing the light receiving unit is represented as E, the control circuit determines that the second ink tank is mounted in the second pocket in a case where B>A and B>C are satisfied, determines that the third ink is mounted in the third pocket in a case where E>D is satisfied, and also determines that the first ink tank is mounted in the first pocket in a case where the second ink tank and the third ink tank are mounted in correct pockets.

2. The printer according to claim 1, wherein a plurality of the third ink tanks are provided in the printer and a plurality of the third pockets are provided in the carriage.

3. The printer according to claim 1, further comprising an electrical line electrically connected with the control circuit and configured to electrically connect with the controllers of the ink tanks which are mounted at the pockets.

4. The printer according to claim 1, wherein the light emitting unit is turned on in accordance with a light emitting command sent from the control circuit.

5. A printer comprising:

N number of ink tanks each including a light emitting unit;

a light receiving unit capable of receiving light from the light emitting unit of at least each of N-1 number of ink tanks;

a carriage including N number of mounting positions to which the N number of ink tanks are detachably mountable, and the carriage being movable so that each of the N-1 number of mounting positions of the N number of mounting positions faces the light receiving unit; and a determining unit configured:

(i) to determine, for each of the N-1 number of mounting positions, whether the ink tank is mounted at a correct mounting position, on the basis of (a) a first light detection amount of the light receiving unit provided by light from the light emitting unit of the ink tank in states that the correct mounting position for the ink tank faces the light receiving unit, and (b) a second light detection amount of the light receiving unit provided by light from the light emitting unit of the ink tank, in states that an adjacent mounting position which is provided adjacent to the correct mounting position for the ink tank faces the light receiving unit, and (ii) to determine that a remaining ink tank other than the N-1 number of ink tanks is mounted at a correct mounting position for the remaining ink tank, in a case where it is determined that the N-1 number of ink tanks are mounted at the correct mounting positions.

6. The printer according to claim 5, wherein the N number of mounting positions include an end mounting position which is located at one end of the N number of mounting positions and which is the correct mounting position for the remaining ink tank, and a particular mounting position which is located adjacent to the end mounting position and which is the correct mounting position for a particular ink tank of the N-1 number of ink tanks, and wherein the determining unit is configured to determine whether the particular ink tank is mounted at the particular mounting position, on basis of a third light detection amount of the light receiving unit provided by light from the light emitting unit of the remaining ink tank in states that the particular mounting position faces the light receiving unit.

7. The printer according to claim 6, wherein the determining unit is configured to determine that the particular ink tank is mounted at the particular mounting position, in a case where the first light detection amount is greater than the second light detection amount is satisfied and the first light detection amount is greater than the third light detection amount is satisfied.

8. The printer according to claim 5, wherein the determining unit is configured to determine, for each of the N-1 tanks, that the ink tank is mounted at the correct mounting position, in a case where the first light detection amount is greater than the second light detection amount is satisfied.

9. The printer according to claim 5, wherein the correct mounting position for the remaining ink tank is not capable of facing the light receiving unit regardless of a movement of the carriage.

10. The printer according to claim 5, wherein the N number of ink tanks are substantially the same configuration.

11. A printer comprising:

a first ink tank, a second ink tank and a third ink tank, each of the first, second and third ink tanks including a light emitting unit;

a light receiving unit capable of receiving light from the light emitting unit of each of the first, second and third ink tanks;

a carriage movable in a moving direction and including a first mounting position for the first ink tank, a second mounting position for the second ink tank and a third mounting position for the third ink tank, the first, second and third mounting positions being arranged along the moving direction in this order and the carriage being movable along the moving direction so that each of the second and third mounting positions faces the light receiving unit; and a determining unit configured:

(i) to determine whether the third ink tank is mounted at the third mounting position, on the basis of (a) a first light detection amount of the light receiving unit provided by light from the light emitting unit of the third ink tank in states that the third mounting position faces the light receiving unit and (b) a second light detection amount of the light receiving unit provided by light from the light emitting unit of the third ink tank in states that the second mounting position faces the light receiving unit;

(ii) to determine whether the second ink tank is mounted at the second mounting position, on the basis of (c) a third light detection amount of the light receiving unit provided by light from the light emitting unit of the second ink tank in states that the third mounting position faces the light receiving unit, (d) a fourth light detection amount of the light receiving unit provided by light from the second ink tank in states the second mounting position faces the light receiving unit, and (e) a fifth light detection amount of the light receiving unit provided by light from the light emitting unit of the first ink tank in states the second mounting position faces the light receiving unit; and (iii) to determine that the first ink tank is mounted at the first mounting position, if the second ink tank is mounted at the second mounting position and the third ink tank is mounted at the third mounting position.

12. The printer according to claim 11, wherein the determining unit is configured:

(i) to determine that the third ink tank is mounted at the third mounting position in a case where the first light detection amount is greater than the second light detection amount is satisfied; and (ii) to determine that the second ink tank is mounted at the second mounting position in a case where the third light detection amount is less than the fourth light detection is satisfied and the fourth light detection amount is greater than the fifth light detection amount is satisfied.

13. The printer according to claim 11, wherein the first mounting position is provided at an end position of the carriage which is not capable of facing the light receiving unit regardless of a movement of the carriage in the moving direction.

14. The printer according to claim 11, wherein the first, second and third ink tanks are substantially the same configuration.

15. A printer comprising:

a first ink tank, a second ink tank, a third ink tank and a fourth ink tank, each of the first, second, third and fourth ink tanks including a light emitting unit;

a light receiving unit capable of receiving light from the light emitting unit of each of the first, second, third and fourth ink tanks;

a carriage movable in a moving direction and including a first mounting position for the first ink tank, a second mounting position for the second ink tank, a third mounting position for the third ink tank and a fourth mounting position for the fourth ink tank, the first, second, third and fourth mounting positions being arranged along the moving direction in this order and the carriage being movable along the moving direction so that each of the second, third and fourth mounting positions faces the light receiving unit; and a determining unit configured:

(i) to determine whether the fourth ink tank is mounted at the fourth mounting position, on the basis of (a) a first light detection amount of the light receiving unit provided by light from the light emitting unit of the fourth ink tank in states that the fourth mounting position faces the light receiving unit and (b) a second light detection amount of the light receiving unit provided by light from the light emitting unit of the fourth ink tank in states that the third mounting position faces the light receiving unit;

(ii) to determine whether the third ink tank is mounted at the third mounting position, on the basis of (c) a third light detection amount of the light receiving unit provided by light from the light emitting unit of the third ink tank in states that the fourth mounting position faces the light receiving unit, (d) a fourth light detection amount of the light receiving unit provided by light from the third ink tank in states the third mounting position faces the light receiving unit, and (e) a fifth light detection amount of the light receiving unit provided by light from the light emitting unit of the third ink tank in states the second mounting position faces the light receiving unit;

(iii) to determine whether the second ink tank is mounted at the second mounting position, on the basis of (f) a sixth light detection amount of the light receiving unit provided by light from the light emitting unit of the second ink tank in states that the third mounting position faces the light receiving unit, (g) a seventh light detection amount of the light receiving unit provided by light from the second ink tank in states the second mounting position faces the light receiving unit, and (h) an eighth light detection amount of the light receiving unit provided by light from the light emitting unit of the first ink tank in states the second mounting position faces the light receiving unit; and (iv) to determine that the first ink tank is mounted at the first mounting position, if the second ink tank is mounted at the second mounting position, the third ink tank mounted at the third mounting position and the fourth ink tank mounted at the fourth mounting position.

16. The printer according to claim 15, wherein the determining unit is configured:

(i) to determine that the fourth ink tank is mounted at the fourth mounting position in a case where the first light detection amount is greater than the second light detection amount is satisfied;

(ii) to determine that the third ink tank is mounted at the third mounting position in a case where the third light detection amount is less than the fourth light detection is satisfied and the fourth light detection is greater than the fifth light detection amount is satisfied; and (iii) to determine that the second ink tank is mounted at the second mounting position in a case where the sixth light detection amount is less than the seventh light detection is satisfied and the seventh light detection is greater than the eighth light detection amount is satisfied.

17. The printer according to claim 15, wherein the first mounting position is provided at an end position of the carriage which is not capable of facing the light receiving unit regardless of a movement of the carriage in the moving direction.

18. The printer according to claim 15, wherein the first, second, third and fourth ink tanks are substantially the same configuration.

* * * * *